US006781615B2

(12) United States Patent
Tsuruta

(10) Patent No.: US 6,781,615 B2
(45) Date of Patent: Aug. 24, 2004

(54) PRINTING APPARATUS AND PRINTING METHOD

(75) Inventor: Wataru Tsuruta, Yamanashi (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/401,750

(22) Filed: Mar. 31, 2003

(65) Prior Publication Data

US 2004/0075730 A1 Apr. 22, 2004

(30) Foreign Application Priority Data

Apr. 4, 2002 (JP) ..... 2002-102741

(51) Int. Cl.[7] ..... B41J 2/325; B41J 25/304

(52) U.S. Cl. ..... 347/213; 347/197

(58) Field of Search ..... 347/213, 197, 347/198, 219, 171–174, 176; 400/120.01, 120.02, 120.04, 618

(56) References Cited

U.S. PATENT DOCUMENTS 5,661,515 A * 8/1997 Hevenor et al. ..... 347/215
5,739,835 A * 4/1998 Morgavi et al. ..... 347/176
6,377,291 B2 * 4/2002 Andoh et al. ..... 347/213
6,642,948 B2 * 11/2003 Miki ..... 347/213
6,693,655 B2 * 2/2004 Fujimoto et al. ..... 347/213

FOREIGN PATENT DOCUMENTS

| | | |
|---|---|---|
| JP | 5-24305 | 2/1993 |
| JP | 8-58125 | 3/1996 |
| JP | 8-332742 | 12/1996 |
| JP | 9-131930 | 5/1997 |

* cited by examiner

*Primary Examiner*—K. Feggins

(57) ABSTRACT

A third reference position on an eccentric cam positions a thermal head touching a follower roller at a retreated position separated from a printing position when printing is idled, and a second reference position of a middle-sized radius on an eccentric cam applies a thermal head touching a follower roller with a pressure of approximately 39 N to a card therebetween interposed by thermal transfer film, when in a direct transfer execution state. Also, when in an indirect transfer execution state, a first reference position on an eccentric cam applies a thermal head touching a follower roller with a pressure of approximately 78 N onto an intermediate transfer film supported by a platen roller having a degree of hardness of approximately 60. This applies the appropriate amount of pressure per unit of surface area and prevents missing transfers. Therefore, regardless of the method of transfer, high quality images can be attained on a plurality of types of media.

20 Claims, 10 Drawing Sheets

PRINTING APPARATUS AND PRINTING METHOD

BACKGROUND OF THE INVENTION

1. Field of the Invention

The present invention is a printing apparatus and a printing method for forming various information such as images and characters on a plurality of types of recording medium or transfer medium, and more particularly relates to a printing apparatus and a printing method that can accurately press against a plurality of types of recording medium or transfer medium having different degrees of hardness to form that information.

2. Description of the Related Art

Conventionally, thermal transfer method printing apparatuses that record desired images and characters by thermally transferring using a thermal head via a thermal transfer film to a recording medium are used to create card shaped recording medium, like credit cards, cash cards, license cards and ID cards. An example can be found in Japanese Patent Publication (Tokkai) 09-131930, which teaches a direct transfer method printing apparatus that directly transfers images and characters to a recording medium via thermal transfer film. The use of a thermal sublimate ink has the benefit of attaining high quality images because this type of ink is more expressive. However, a receptive layer to receive ink on the surface of a recording medium to which images, etc., are transferred is an essential element to make this method of printing possible. Therefore, there is the problem that the types of recording medium that can be used is limited, or else it is necessary to form a receptive layer upon the surface of a recording medium.

Generally, cards made of polyvinyl chloride (also known as PVC cards) are widely used as a recording medium because they can receive thermal sublimate ink. However, due to the fact that harmful substances are generated when these cards are burned, consideration is being given to switching to cards made of polyethylene terephthalate (also known as PET cards). However, because PET cards are made of a crystallized material, they are not only difficult to use in a thermal sublimate transfer process, but they are also difficult to use in embossing. For that reason, when it is necessary to emboss the recording medium, PCV will have to be used well into future.

Furthermore, in recent years, there are card shaped media that have IC chips or antennae embedded therein. Such IC cards are used in a variety of fields. Because there is an object embedded in the card, the surface of the card ends up being uneven which results in image transfer problems.

Japanese laid-open patent publication 8-332742 teaches the technology of a thermal transfer method printing apparatus that overcomes the aforementioned problems in an indirect transfer method printing apparatus that transfers an image to an intermediate transfer medium once, then transfers that image again to the recording medium. According to this method, it is possible to overcome the problems of the direct transfer method, such as the limit to the type of recording medium, related to the receptive layer, or the problem of the transferring of images to an uneven surface of the recording medium, both of which are considered to be demerits of direct transfer printing. Furthermore, this method has the advantage of being easier to printing to the entire surface of the card shaped recording medium compared to the direct transfer method.

Still further, Japanese laid-open patent publication 8-58125 discloses a thermal transfer printing apparatus that is structured to dually use a thermal head to transfer ink to an intermediate transfer film to transfer and form an image thereupon, then to retransfer that ink image to a recording paper using a heat roller, and to use a thermal head which is different to the aforementioned thermal head to transfer ink to the back side of a recording paper, to print to both the front and back sides of a recording paper.

However, running costs associated with the intermediate transfer method are higher than those for the direct transfer method because an intermediate transfer medium must be used. Printing also takes longer. Furthermore, depending on the design of the card, even if the entire front surface is required for printing, often times the back side is used only to print precautions for card use. Therefore, there are fewer cases requiring printing over the entire surface, so there are merits and demerits for both methods of printing. Therefore, if there were a printing apparatus that can switch between the printing methods of a direct transfer method and an indirection transfer method to print images to a recording medium according to the characteristic of a recording medium, including the quality of the material of the recording medium, like PVC or PET, or whether or not it is embossed or includes IC elements, and whether it is necessary to print to the entire surface of the recording medium, it would be possible to transfer (or print) using the method best suited that particular recording medium. This, in turn, would reduce the running costs that are associated with printing. Also, by sharing a part of the members between the direct transfer method and the indirect transfer method the entire printing apparatus can remain smaller and this would enable a printing apparatus with reduced running costs. Therefore, it is conceivable that an apparatus thus capable would become quite widely used. However, because there is a difference in hardness, caused by the thicknesses or structure comprised by each of a recording medium, such as a card formed with print information such as images by a thermal head and an intermediate transfer medium such a intermediate transfer film, it is difficult to attain high quality images under the same image transfer conditions.

Specifically, on printing apparatuses that comprise a thermal head, often times a platen roller is used to support a recording medium (or transfer medium) interposed therebetween a thermal head by an ink ribbon during printing. Rubber rollers are generally used for the platen roller, thus if the pressing force of the thermal head is constant when forming images onto a less-hard transfer medium with the pressing force having a value set for a harder transfer medium, the uneven surface of the platen roller can affect the less-hard transfer medium thereby causing transfer defects, or so-called insufficient or missing transfers onto the transfer medium. Needless to say, this notably reduces the quality of the image that is transferred. A relatively less-hard platen roller can also have an affect. It is conceivable to employ a platen roller with a higher degree of hardness, but if there is dirt or other foreign matter adhering thereto the surface, that area thereof cannot be reproduced, rather that hollowed area is supported which causes poor transfers, such as missing transfers when forming the next image. Therefore, it is necessary for the degree of hardness of a platen roller be lowered somewhat and to have some resilience. On the other hand, if an image is formed on a transfer medium that has a higher degree of hardness using a pressure set for a transfer medium that has a lower degree of hardness, with the pressure of the thermal head at a constant, this will hinder transport when forming an image onto the transfer medium because the pressing contact force for both is too large. This will speed up the wear-out of the thermal head or it can cause new problems such as scratching, cracking or otherwise degrading of the ink ribbon and making it difficult to achieve satisfactorily formed images.

For that reason, it is preferable to form images by changing the pressing force of the thermal head for a plurality of transfer medium types. Prior art, such as that disclosed in Japanese Patent Publication (Hei) 5-24305, teaches a technology of a head pressing apparatus on a printer to vary the pressing force of the thermal head. With this technology, the pressing force is set high for paper which is thicker than regular copy paper, such as a post card, and set slightly lower for such regular copy paper considering the amount to subtract according to the strength of that paper. This ensures a quality print when printing to paper that has differing thicknesses and degrees of smoothness.

Although the technology disclosed in Japanese Patent Publication (Hei) 5-24305 ensures the printing quality on paper having different thicknesses and degrees of smoothness, when considering its application to a printing apparatus that can transfer both directly and indirectly, the differences in hardness of a hard card-shaped recording medium and the soft, pliable quality of film-shaped transfer medium make it difficult to ensure a good quality print using both transfer methods. A high degree of printing quality, free of missing transfers, is particularly required on card-type recording medium because they also function as personal IDs, regardless of the either the direct transfer method or the indirect transfer method.

OBJECT OF THE INVENTION

An object of the present invention is to provide a printing apparatus and a printing method that can ensure high quality printed images free of missing transfers on a plurality of media, regardless of the type of transfer method used.

SUMMARY OF THE INVENTION

According to the first aspect of the present invention, at least one printing means for forming images on a plurality of transfer medium having differing degrees of hardness is provided, and pressing application means for applying a pressure to the aforementioned printing means so that the pressure applied to a soft first transfer medium is higher than the pressing force applied to a hard second transfer medium when forming images to the aforementioned transfer medium, on a printing apparatus that forms images onto a transfer medium with the printing means pressed against the transfer medium.

According to this aspect of the invention, when forming images to a plurality of transfer medium that have differing degrees of hardness, on at least one printing means for forming an image, a pressure is applied by the pressure application means to a soft first transfer medium, that is higher than the pressure applied to a harder second transfer medium, and an image is formed to a transfer medium by the printing means being pressed against the transfer medium. According to this aspect, the pressure application means applies a pressure to the softer first transfer medium that is larger than the pressure to a hard second transfer medium on the printing means, so the appropriate amount of pressure can be applied to the transfer medium regardless of the degree of its hardness, thereby ensuring high quality printing that does not have missing transfers. An example for a first transfer medium could be a film-shaped transfer medium and for a second transfer medium, an example could be a card-shaped transfer medium that comprises a predetermined hardness.

In this embodiment, a first mode for forming an image onto a first transfer medium, mode setting means for setting a second mode for forming an image on a second transfer medium, and pressure control means for controlling the pressure applied to printing means by a pressure application means according to the first or the second mode as set by that mode setting means. The pressure applied to the printing means by the pressure application means is controlled by the pressure control means to vary according to the mode that is set by the mode setting means, so it is possible to apply pressure to the printing means that is appropriate for the transfer method (or the mode) in use. Also, provided are detection means for detecting the existence of the first transfer medium and pressure control means for controlling the amount of pressure to apply to the printing means by the pressure application means, based on a detection signal from that detection means. When this detection means detects the existence of the first transfer medium, a high amount of pressure is applied to the printing means by the controls from the pressure control means. This eliminates miss-operation between the first and second transfer medium.

If the structure of the pressure application means includes an advancing and retreating movement regulation member that advances and retreats the printing means between an image forming position and a retracted position separated from the image forming position, and a resilient member for absorbing resistance that is generated in the direction opposite to the direction of pressure onto the first transfer medium or the second transfer medium of the printing means, the position thereof regulated by the advancing and retreating movement regulation member. The pressure application means can ensure the advancing and retreating operations with regard to the pressure between the printing means image forming position and the retreated position using the advancing and retreating movement regulation member. Because the resilient member absorbs the resistance at the image forming position of the printing means that is generated in the direction opposite to the pressing direction with regard to the transfer medium, it is possible to hold the pressure to a predetermined pressure on the first or the second transfer medium. For the advancing and retreating regulating member, it is acceptable, for example, to furnish a first reference position that applies a large pressure on a first transfer medium, a second reference position that applies a small pressure to a second transfer medium and a third reference position that does not apply pressure to either the first or the second transfer medium on an eccentric cam that comprises an outer surface.

A second aspect of the present invention is a printing apparatus comprising first printing means for forming an image on a recording medium, second printing means for forming an image on an intermediate transfer medium that temporarily holds an image, transfer means for transferring the image on the intermediate transfer means to the same recording medium above or a different recording medium, and advancing and retreating means for advancing and retreating the first and the second printing means from an image forming position and a position separated from the image forming position. The pressure on the intermediate transfer medium at the second printing means when the second printing mean is positioned at the image forming position by the advancing and retreating means is configured to be greater than the pressure on the recording medium of the first printing means when position at the image forming position by the advancing and retreating means.

According to this aspect of the invention, the first printing means that forms an image onto a recording medium, and the second printing means for forming an image onto an intermediate transfer medium that temporarily holds an image advance and retreat by the advancing and retreating means between an image forming position and a position separated therefrom. When the first and second printing means are positioned at the image forming position by the advancing and retreating means, the pressure on the intermediate transfer medium of the second printing means is greater than the pressure on the recording medium of the first recording medium. Accordingly, when the first and the second printing means are positioned at each of the image forming positions by the advancing and retreating means, the pressure on the intermediate transfer medium of the second printing means is configured to be higher than the pressure on the recording medium of the first printing means. This applies a higher pressure on the intermediate transfer medium which has a lower degree of hardness, than the pressure applied to the recording medium which has a higher degree of hardness, so the appropriate amount of pressure can be applied to both types of recording medium, regardless of whether the transfer medium or the recording medium have a high low degree of hardness. This ensures high quality printing without missing transfers. In this aspect of the invention, an example for a recording medium could be a card-shaped transfer medium that comprises a predetermined hardness and for the intermediate transfer medium, an example could be a transfer medium formed onto a film-shaped media.

Furthermore, according to this aspect, further provided are mode setting means for setting a first mode for transferring an image on an intermediate transfer medium to a recording medium using a transfer means after forming an image onto the intermediate transfer medium by the second printing means, or to a different recording medium, and a second mode for forming an image onto a recording medium using the first printing means, and pressure control means for controlling the pressure applied to the first or the second printing means that are positioned at the image forming position by the advancing and retreating means, according to the first or the second mode set by the mode setting means. Because the pressure control means controls the pressure being applied to the first or the second printing means positioned at the image forming position by the advancing and retreating means to vary accordingly, the pressure which is appropriate to that printing means can be applied thereto. Also provided are detection means for detecting the existence of the intermediate transfer medium, and pressure control means for controlling the amount of pressure applied to the second printing means that is positioned at an image forming position by the advancing and retreating means to be larger than the pressure applied to the first printing means positioned at an image forming position by the advancing and retreating means, based on a detection signal from that detection means. When detection means detect the existence of the intermediate transfer medium, the pressure control means controls so that a high amount of pressure is applied to the first printing means that is positioned at an image forming position by the advancing and retreating means. This eliminates miss-operation between the intermediate transfer medium and the recording medium.

The advancing and retreating means comprises an eccentric cam that regulates the amount of movement in the advancing or retracting movement of the first printing means and the second printing means. The rotation of this eccentric cam is structured to position the first printing means or the second printing means at an image forming position. The advancing and retreating means can also comprise a resilient member to absorb resistance in the pressure generated by the first printing means and the second printing means. Still further, the first printing means and the second printing means comprise a thermal head to perform a thermal transfer. It is perfectly acceptable for the eccentric cam and resilient member to be arranged in pairs in the same direction on the length direction of the thermal head. Also, the first printing means and second printing means print elements can be configured with the same printing elements.

Still further, a third aspect of the invention is a printing method. In this method, a card-shaped recording medium having a predetermined hardness is transported to an image forming position. It includes a first printing process for forming an image on that recording medium at that image forming position, and a second printing process that transports a film-shaped intermediate transfer medium that temporarily holds an image to that image forming position, then after the forming of an image thereupon at that image forming position, it transports that intermediate transfer medium to an image transfer position while also transporting that card-shaped recording medium or a different card-shaped recording medium to that image transfer position and transfers the image formed on the intermediate transfer medium at that image transfer position to that card-shaped recording medium or a different card-shaped recording medium to form an image thereupon. In this method, the pressure on the film-shaped intermediate transfer medium when forming an image thereupon in the second printing process is configured to be higher than the pressure applied to the card-shaped recording medium when forming an image there in the first printing process.

These and other objects, aspects and embodiments of the present invention will now be described in more detail with reference to the following drawing figures.

DETAILED DESCRIPTION OF THE DRAWINGS

FIG. 1 is a front view showing the conceptual structure of a printing apparatus of an embodiment to which this invention can be applied.

FIG. 2A, FIG. 2B and FIG. 2C show an embodiment of the image forming portion of the printing apparatus; FIG. 2A is an external perspective view; FIG. 2B is a sectional side view of a part thereof, FIG. 2C is a sectional plan view of a part thereof.

FIG. 4A is a front view of the thermal transfer film, FIG. 4B is a sectional view of the intermediate transfer film.

FIG. 9A shows an eccentric cam positioned at a third reference position; FIG. 9B shows an eccentric cam positioned at a second reference position; and FIG. 9C shows an eccentric cam positioned at a first reference position.

FIG. 10A shows the heat roller retracted; FIG. 10B shows transferring an image onto a card using intermediate transfer.

DETAILED DESCRIPTION OF THE PREFERRED EMBODIMENTS

The following is a detailed description of an embodiment of the printing apparatus that applies the invention in reference to the drawings.

Figure 1:
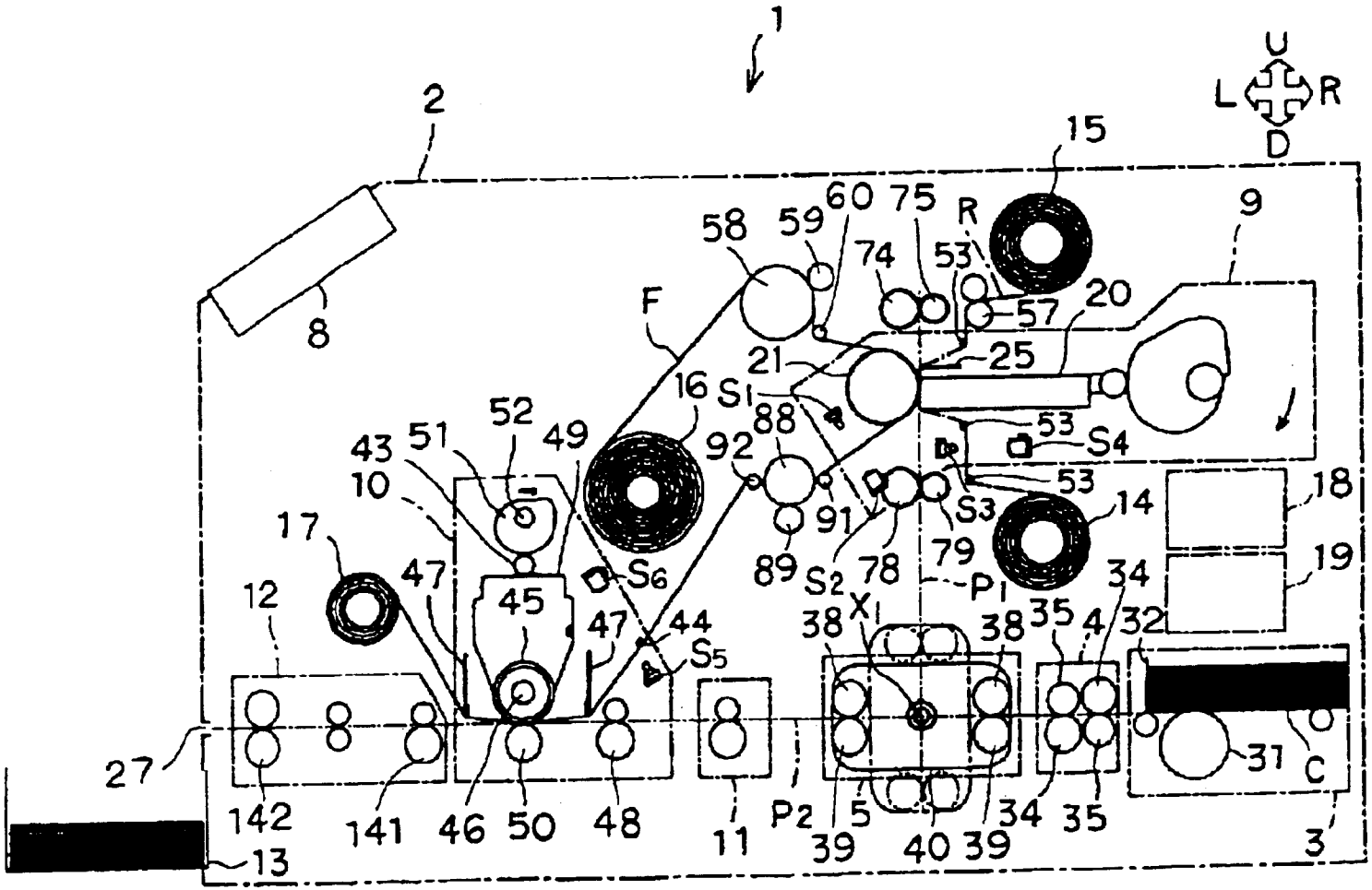
Figure 2A:
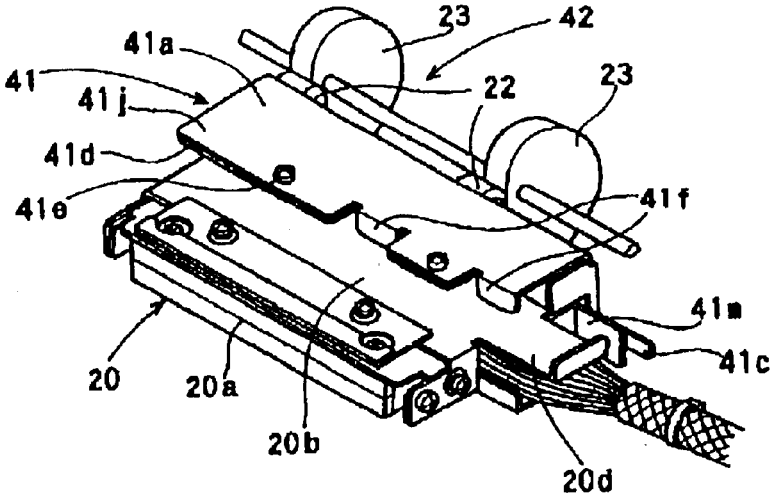
Figure 2B:
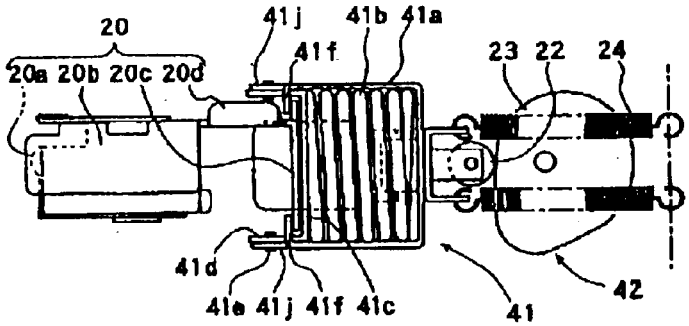
Figure 2C:
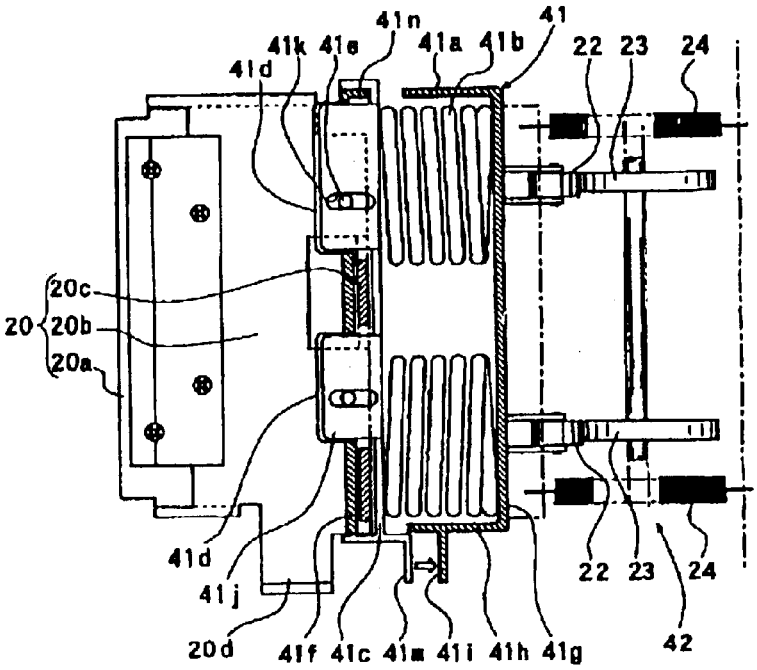

As is clearly shown in FIG. 1, the printing apparatus 1 comprises in the housing of the frame 2, the first card transport path P1 comprising a card transport path for forming (printing) images to the card C, using the direct transfer method, and the second card transport path P2 comprising of a card transport path for transferring to the card C images temporarily held on the intermediate transfer film F, using the indirect transfer method. The second card transport path P2 is arranged substantially horizontally, and the first card transport path P1 is arranged substantially vertically. The first card transport path P1 and the second card transport path P2 intersect orthogonally at intersecting point X1.

On the second card transport path P2 are arranged the card supply portion 3 that separates and feeds the card C one at a time to the second card transport path P2, the cleaner 4 that cleans both surfaces of the card C downstream of the card supply portion 3, and the turning portion 5 that rotates or inverts while nipping the card C to turn its transport path to be orthogonally arranged to the first card transport path P1 direction using the intersection point X1 downstream of the cleaner 4 as the center of rotation.

The card supply portion 3 comprises the card stacker that stores a stack of a plurality of the card C. The stacker side plate 32 that comprises an opening slot to allow only one of the cards C to pass therethrough is arranged to face the second card transport path P2 on the card stacker. To the bottom of the card stacker is pressingly arranged the kick roller 31 that rotatingly feeds the bottommost blank card C of the plurality of blank cards C that are stackingly stored in the card stacker, to the second card transport path P2.

The cleaner 4 comprises the cleaning roller 34 which is made of a rubber material, the surface thereof applied with an adhesive substance, and the pressing roller 35 that presses against the cleaning roller 34. The cleaning roller 34 and the pressing roller 35 opposingly face each other to sandwich the second card transport path P2.

The turning portion 5 comprises the pinch rollers 38 and 39 that are paired to nip the card C and comprises the turning frame 40 that turns or rotates around the intersecting point of X1, rotatingly supporting these pinch rollers. One of the pinch rollers 38 and 39 is a forward and reversingly rotatable drive roller, and the other is a follower roller. The pinch rollers 38 and 39 are in pressing contact to sandwiching the second transport path P2 when the turning frame 40 is horizontally positioned (the state indicated by the solid lines in FIG. 1) and are in pressing contact to sandwich the first card transport path P1 when the turning frame 40 is vertically positioned (the state indicated by the dotted lines in FIG. 1). When the turning frame 40 is rotated or turned while nipping a card between the pinch rollers 38 and 39, the pinch rollers 38 and 39 would also rotate thereby displacing the card C, so the rotating or turning action at the turning portion 5 is driven independently to the rotation or inversion of the turning frame 40 and to the rotation of the pinch rollers 38 and 39.

Note that near the turning portion 5 is arranged the unitized transmissive sensor (combined with the slit plate), not shown in the drawings, to detect the angle of rotation of the turning frame 40. Also, to determine the direction of rotation of the pinch rollers 38 and 39, a unitized transmissive sensor (combined with a semi-circular plate), also not shown in the drawings, is arranged to detect the position of either of one of the pinch rollers 38 and 39. While the angle of rotation of the rotating frame 40 can be freely set, the direction of the transport of the card C by the pinch rollers 38 and 39 is controlled.

In the printing apparatus 1, downstream of the turning portion 5 (on the arrow U direction in FIG. 1) on the first card transport path P1 is arranged an image forming portion 9 that uses thermal transfer ink to form images on the card C or the intermediate transfer film F according to image data (both positive and negative images) supplied from the thermal head control portion 19H (see FIG. 5), which is described below. A thermal transfer printer configuration is employed in the image forming portion 9 which comprises the platen roller 21 that supports the card C and the intermediate transfer film F when printing to a surface thereof and the thermal head unit 20 which is retractably arranged to the platen roller 21. The rubber having a hardness of approximately 60 degrees is used in the platen roller 21. The thermal transfer film R is interposed between the platen roller 21 and the thermal head unit 20.

Figure 4A:
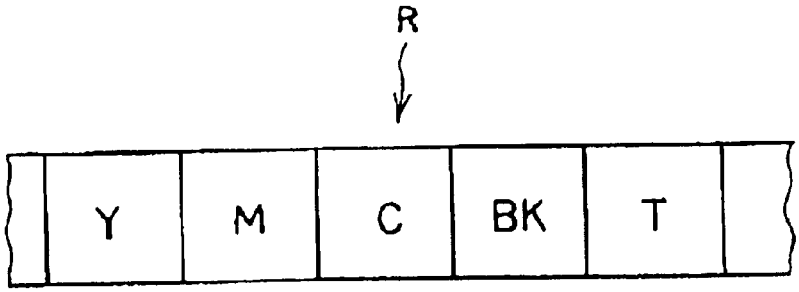
FIG. 4A and FIG. 4B are drawings of the thermal transfer film and intermediate transfer film.
Figure 4B:
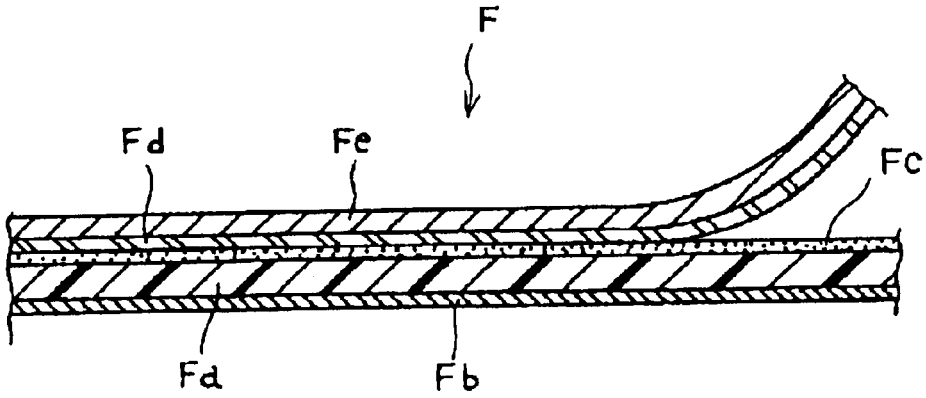

As clearly shown in FIG. 4A, the thermal transfer film R comprises the thermal sublimate inks of Y (yellow), M (magenta), C (cyan) and Bk (black) in that order at a width that is slightly longer than the length direction of the card C on a film. After the Bk (black) section there is a protective layer region for protecting the surface of the card C that has been formed thereupon with an image. Each of these sections are formed repeatedly in order to form a band shape. The band is generally called an ink ribbon. On the other hand, as shown in FIG. 4B, on the intermediate transfer film F is formed the layers of the base film Fa, the back surface coating layer Fb formed on the back side of the base film Fa, the receptive layer Fe that receives ink, and the overcoat layer Fd that protects the receptive layer Fe surface. The peeling surface Fc is formed on the base film Fa and aids in the heat peeling of the overcoat layer Fd and the receptive layer Fe from the base film Fa as a single piece. The back surface coating layer Fb, the base film Fa, the peeling surface Fc, the overcoat layer Fd, and the receptive layer Fe are formed in layers in that order from the bottom.

As is shown in FIG. 2A to FIG. 2C and FIG. 19A to FIG. 9C, the advancing and retracting movement of the thermal head 20 to and from the platen roller 21 is performed by a thermal head drive mechanism 41 that comprises a head holder 41 that that removably holds the thermal head unit 20, the follower roller 22 which is mounted to the head holder 41, and a spring 24 that presses the head holder 41 against the eccentric cam 23. Specifically, in the thermal head drive mechanism 42, the thermal head unit 20 that is held in the head holder 41 is advanced and retreated to the printing position (the heating position) by the rotating of the eccentric cam 23. The printing position Sr, interposed by the thermal transfer film R, is at the outer circumference of the platen roller 21 and corresponds to the portion that touches the first card transport path P1.

A substantially box-shaped base frame 41*a*, spring 41*b* that absorbs the resistance generated in the direction opposite to the pressing direction when pressing the thermal head 20*a* that comprises a plurality of heating elements for forming images, and that is the leading edge portion of the thermal head unit 20 and stored inside the base frame 41*a*, and the spring bearing member 41*c* that is pressed toward the thermal head 20*a* by the spring 41*b* inside the base frame, compose the head holder 41. In the base frame 41*a* are the support plate 41*d* that swingingly supports the spring bearing member 41*c* at the mounting side of the thermal head unit 20, the guide pin 41*e* established on the support plate 41*d* and the stopper pawl 41*f* that stops the thermal head unit 20. The base frame 41*a* supports the follower roller 22 at the wall surface 41*g* on the opposite side thereof. A fixed plate 41*i* projects from the wall surface 41*h* on the thermal head 20*a* removal side on the base frame 41*a*.

The spring bearing member 41*c* comprises the swinging plate 41*j* that extends parallel with the support plate 41*d* and corresponds to the support plate 41*d* on the base frame 41*a* and the fixed plate 41*i*, the guide hole 41*k* therein inserted by the guide pin 41*e* which reciprocally movable in the advancing and retreating directions of the thermal head unit 20, and the protruding stopper plate 41*m* extending in parallel to the fixed plate 41*i* which is formed on the swinging plate 41*j*. Also, the spring bearing member 41*c* comprises the stopper 41*n* on the opposite edge of the stopper plate 41*m*.

Therefore, the spring bearing member 41*c* normally touches the stopper pawl 41*f* by being pressed to the head side on the base frame 41*a* by the spring 41*b*. The stopper plate 41*m* approaches the fixed plate 41*i* by manually pinching and pressing together the fixed plate 41*i* on the base frame 41*a* and the stopper plate 41*m* on the spring bearing member 41*c*. As a result, the thermal head 20*a* side wall surface on the base frame 41*a* and the spring bearing member 41*c* separate.

The thermal head unit 20 comprises the head holding member 20*b* that enables it to be removed from the base frame 41*a*. The head holding member 20*b* comprises the stopper plate 20*c* that is sandwiched between the stopper pawl 41*f* on the base frame 41*a* and the spring bearing member 41*c* and the pull-out plate 20*d* for pulling the thermal head unit 20 out from the device. The head holding member 20*b* is detachably mounted in the length direction space surrounded by the support plate 41*d* which overlaps thereto, the swinging plate 41*j* and the stopper 41*n*. Also, arranged in pairs along the length direction (main scanning direction) of the thermal head 20*a* are the eccentric cam 23, the springs 24, the follower rollers 22 and the springs 41*b*.

By controlling the rotation of the eccentric cam 23 on the thermal head drive mechanism 42, it is possible to select either the thermal head unit 20 to idle away from printing with the thermal head 20*a* at the retreated position which is separated from the printing position Sr, a direct transfer execution state (see FIG. 9B) using the direct transfer mode to pressingly contact the thermal head 20*a* to the surface of the card C therebetween interposed by the thermal transfer film R when forming an image onto a recording medium (transfer medium) having a predetermined thickness and a predetermined degree of hardness, such as the card C, and the indirect transfer execution state (see FIG. 9C) using the indirect transfer mode to pressingly contact the thermal head 20*a* to the surface of the intermediate transfer film F therebetween interposed by the thermal transfer film R, when forming an image on the intermediate transfer film F which does not have such a degree of hardness as a card C.

Figure 9A:
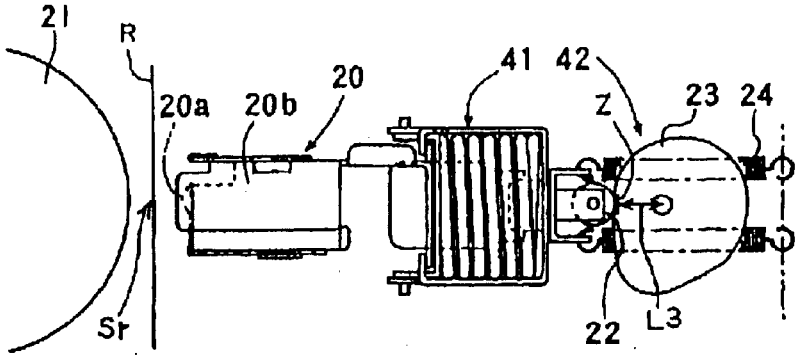
FIG. 9A, FIG. 9B and FIG. 9C are front views of the image forming portion of the printing apparatus according an embodiment thereof.

Specifically, as shown in FIG. 9A, when idling from printing, the third reference position Z, which has the smallest radius L3 on the outer circumference of the eccentric cam 23, touches follower rollers 22, and positions the thermal head 20*a* at a retreated position away from the thermal transfer film R (the printing position Sr). The thermal head 20*a* is idled to be able to quickly move to the position where it touches the thermal transfer film R when the print command is received. Also, as clearly shown in FIG. 9B, in a direct transfer execution state, the second reference position Y which has the middle sized radius L2 on the outer circumference of the eccentric cam 23, touches follower rollers 22, and touches the thermal head 20*a* against the card C interposed therebetween by the thermal transfer film R. In this state, by selectively heating a plurality of heating elements on the thermal head 20*a*, the thermal transfer ink components dispensed to the thermal transfer film R are thermally transferred to the surface of the card C, thereby forming an image of the desired image information onto the surface of the card C. Also, as clearly shown in FIG. 9C, in an indirect transfer execution state, the first reference position X which has the largest sized radius L1 on the outer circumference of the eccentric cam 23, touches follower rollers 22, and touches the thermal head 20*a* against the intermediate transfer film F interposed therebetween by the thermal transfer film R. In this state, by selectively heating a plurality of the heating elements on the thermal head 20*a*, the thermal transfer ink components dispensed to the thermal transfer film R are thermally transferred to the surface of the intermediate transfer film F, thereby forming an image of the desired image information onto the surface of the intermediate transfer film F.

Figure 9B:
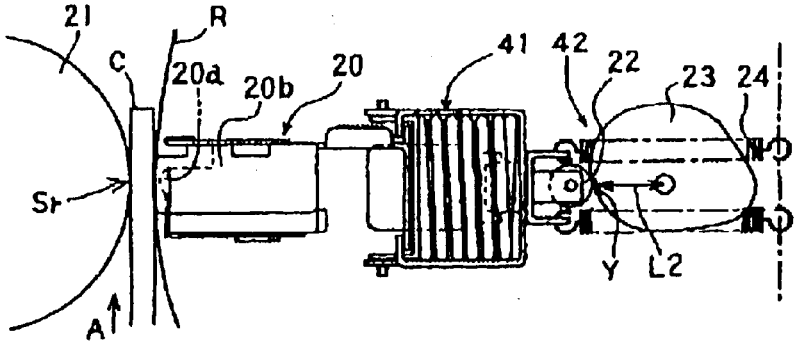

In the direct transfer execution state and the indirect transfer execution state, the thermal transfer film R and the card C or the intermediate transfer film F move at the same speed in the direction of the arrow A in FIG. 9B relative to the thermal head 20*a*. The card C or the intermediate transfer film F pass through the printing position Sr and when printing is completed, the thermal head 20*a* shifts back to the printing retreated position as depicted in FIG. 9A. To continue printing to another card C or to the intermediate transfer film F, the thermal head 20*a* is shifted again to the positions shown in FIG. 9B or FIG. 9C. In other words, to continuously print to the cards C, the thermal head unit 20 repeatedly moves between a printing idle state and a direct transfer execution state. Or to continuously print to the intermediate transfer film F, the thermal head unit 20 repeatedly moves between a printing idle state and an indirect transfer execution state, or to printing to both the card C and to the intermediate transfer film F, it is possible to selectively repeat in any order, the printing idling state, the direct transfer execution state or the indirect transfer execution state for the thermal head unit 20 to print to both types of media.

To describe the degree of hardness of the platen roller 21, the card C and the intermediate transfer film F in more detail, if the card C material is PVC, for example, it is approximately 98 degrees Hs. The intermediate transfer film F is a film so it does not have the same degree of hardness and depends upon the hardness of the platen roller 21. Specifically, if the platen roller 21 is a rubber roller having a degree of hardness of approximately 60 degrees Hs, an image can be formed on the intermediate transfer film F equivalent to the hardness of approximately 60 degrees Hs when forming an image on the intermediate transfer film F.

Also, the thermal head 20*a* is positioned at the printing position Sr that touches the card C or the intermediate transfer film F therebetween interposed by the thermal transfer film R in the direct transfer execution state and the indirect transfer execution state. The thermal head 20*a* on the thermal head unit 20, the position of which is regulated by the rotation of the eccentric cam 23 on the thermal head drive mechanism, is positioned at the printing position Sr when printing by the pressure in the direction opposite the card C or the intermediate transfer film F and by an equilibrium state that is generated with the resistance in the opposite direction. Thus, as just described, the spring 41*b* stored in the base frame 41*a* comprises a function for absorbing resistance.

Figure 9C:
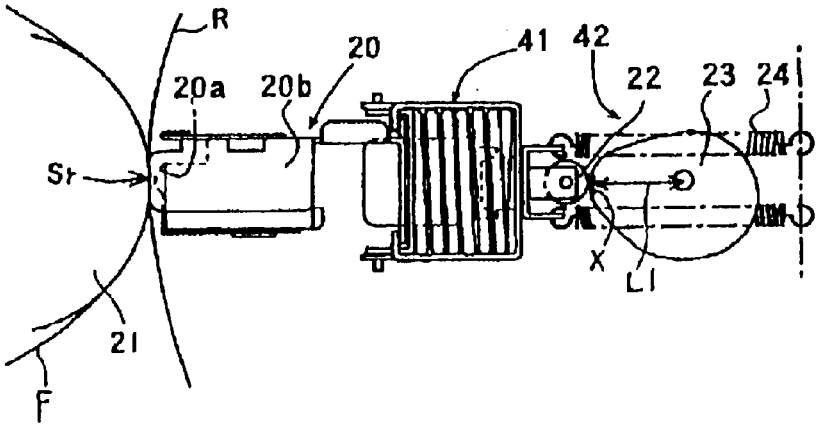

Still further, as shown in FIG. 9C, the pressure on the intermediate transfer film F by the thermal head 20*a* (the thermal head unit 20) when indirectly transferring to the intermediate transfer film F, is controlled to be greater than the pressure on the card C by the thermal head 20*a* when directly transferring to the card C, as shown in FIG. 9B. Specifically, when in a direct transfer execution state to the card C, the pressure on the card C by the thermal head 20*a* is set to be approximately 39 N (approximately 4 kfg). When in an indirect transfer execution state to the intermediate transfer film F, the pressure on the intermediate transfer film F by the thermal head 20*a* is set to the approximately 78 N (or approximately 8 kgf).

As shown in FIG. 1, the thermal transfer film R supplied from the thermal transfer film supply portion 14 where the thermal transfer film R is wound in a roll, guided by a plurality of guide rollers 53 and the guide plate 25 which is mounted to the holder, not shown in the drawings. While touching substantially the entire surface of the leading edge of the thermal head unit 20, the thermal transfer film R is driven along by the rotational drive of the paired take-up rollers 57 and rolled onto the thermal transfer film take-up portion 15. The thermal transfer film supply portion 14 and the thermal transfer film take-up portion 15 are arranged in positions on both sides of the thermal head unit 20, the centers thereof mounted onto the spool shaft. To the image forming portion 9, the light emitting element S3 and light receiving element S4 (hereinafter called the light reception sensor S4) for detecting the mark for positioning of the thermal transfer film R or the position of the Bk portion on the thermal transfer film R, are separately arranged at a right angles to the thermal transfer film R between the guide rollers 53 arranged between the thermal transfer sheet supply portion 14 and the thermal head unit 20.

Note that to the drive side roller shaft of the paired take-up rollers 57 is mated a gear, which is not shown in the drawings. The gear meshes with the gear that comprises the clock plate not shown in the drawings on the same shaft. Near the clock plate (not shown) is arranged the unitized transmissive sensor, which also is not shown, that detects the rotation of the clock plate to control the amount of take-up of the thermal transfer film R. The motor force to wind the thermal transfer film R and the motor force to rotate the aforementioned eccentric cam 23 are supplied by the pulse motor M4, not shown in the drawings, which is the single drive source, via differing motor force transmission systems using gears.

As shown in FIG. 1, on both sides of the image forming portion 9 are arranged the paired upper rollers composed of the capstan roller 74 that has a constant rotating speed, the pinch roller 75 pressing thereto and the lower paired rollers configured by the capstan roller 78 and the pinch roller 79 that sandwich the first card transport path P1 and rotate in synchronization to the moving of the card C in the up and down directions with regard to the printing position Sr.

Also, to the platen roller 21 is trained the intermediate transfer film F on the outer circumference of the thermal head unit 20 side. The intermediate transfer film F is trained with the receptive layer Fe opposing the thermal transfer film R and the back surface coating layer Fb side touching the platen roller 21. At the printing position Sr, the transport speed of the intermediate transfer film F when printing to the card C using the direct transfer method (see FIG. 9B) and when forming images on the intermediate transfer film (see FIG. 9C), is set to the same speed as that for the transport speed of the thermal transfer film R. Furthermore, when printing to the card C using the direct transfer method, the transport speeds of the intermediate transfer film F and the card C are set to be the same. Note that to the image forming portion 9, the light emitting element S1 and the light receiving element S2 (called light reception sensor S2 below) that detects the mark for positioning of the intermediate transfer film F are separately arranged at right angles to the intermediate transfer film F between the platen roller 21 and guide roller 91. This arrangement can be seen in FIG. 1.

Additionally, on the second card transport path P2, downstream of the turning portion 5 on the image forming apparatus 1 are disposed the paired horizontal transport rollers 11 that transport the card C in the horizontal direction, the transfer portion 10 that transfers images formed on the intermediate transfer film F at the image forming portion 9 to the card C, and the horizontal transport portion 12 comprising the paired discharge rollers 142 that discharge the card C outside of the frame 2 and a plurality of paired transport rollers that transport the card C in the horizontal direction.

The transfer portion 10 comprises the platen roller 50 that supports the card C when transferring from the intermediate transfer film F to the card C and the heat roller 45 slidably arranged to the platen roller 50. Embedded in the heat roller 45 is the heating lamp 46 as the heating body that heats the intermediate transfer film F. The intermediate transfer film F is interposed between the platen roller 50 and heat roller 45.

As is shown in FIG. 1A and FIG. 1B, the advancing and retracting movement of the heat roller 45 toward the platen roller 50 is executed by the elevator drive unit that comprises the holder 49 that removably holds the heat roller 45, the follower roller 43 that is fastened to the holder 49, the non-circular heat roller elevator cam 51 that rotates in one direction (the direction of arrow B in the drawing) around the cam shaft 52 while following the outer contour of the follower roller 43 and the spring, not shown in the drawings, that presses the upper surface of the holder 49 against the heat roller elevator cam 51.

The intermediate transfer film F is supplied from the intermediate transfer film supply portion 16, the intermediate transfer film F rolled thereabout, and is guided by the transport roller 58 that is accompanied by the follower roller 59, the guide roller 60 and platen roller 21, the guide roller 91, the back tension roller 88 that applies a reverse tension to the intermediate transfer sheet F along with the pinch roller 89, the guide rollers 92 and 44 and the guide plate 47 mounted to the frame configuring the transfer portion 10 arranged on both sides of the heat roller 45. When transferring, the card C is sandwiched between the platen roller 50 and heat roller 45 on the second card transport path P2 and the intermediate transfer film F is taken up by the intermediate transfer film take-up portion 17 that takes up the intermediate transfer film F.

In addition, to the transfer portion 10, downstream of the paired horizontal transport rollers 11 and upstream of the platen roller 50, are arranged the paired transport rollers 48 that are pressed together to sandwich the second card transport path P2 to transport the card C in the direction of the arrow L along with the paired capstan rollers 141 arranged at the transfer portion 10 on the horizontal transport path 12. They are the drive rollers for the capstan roller. The paired horizontal transport rollers 11, paired transport rollers 48, platen roller 50 and each of the paired rollers on the horizontal transport portion 12 downstream of the turning portion 5 on the second card transport path P2 are rotatingly driven by the pulse motor M3 not shown in the drawings, via a plurality of gears. Note that in the image forming portion 10, the light emitting element S5 and light receiving element S6 (hereinafter referred to as light receiving sensor S6) for detecting the mark for positioning and for detecting the existence of the intermediate transfer sheet F are arranged on either side straddling the intermediate transfer film F between the guide roller 44 and guide plate 47.

Figure 3:
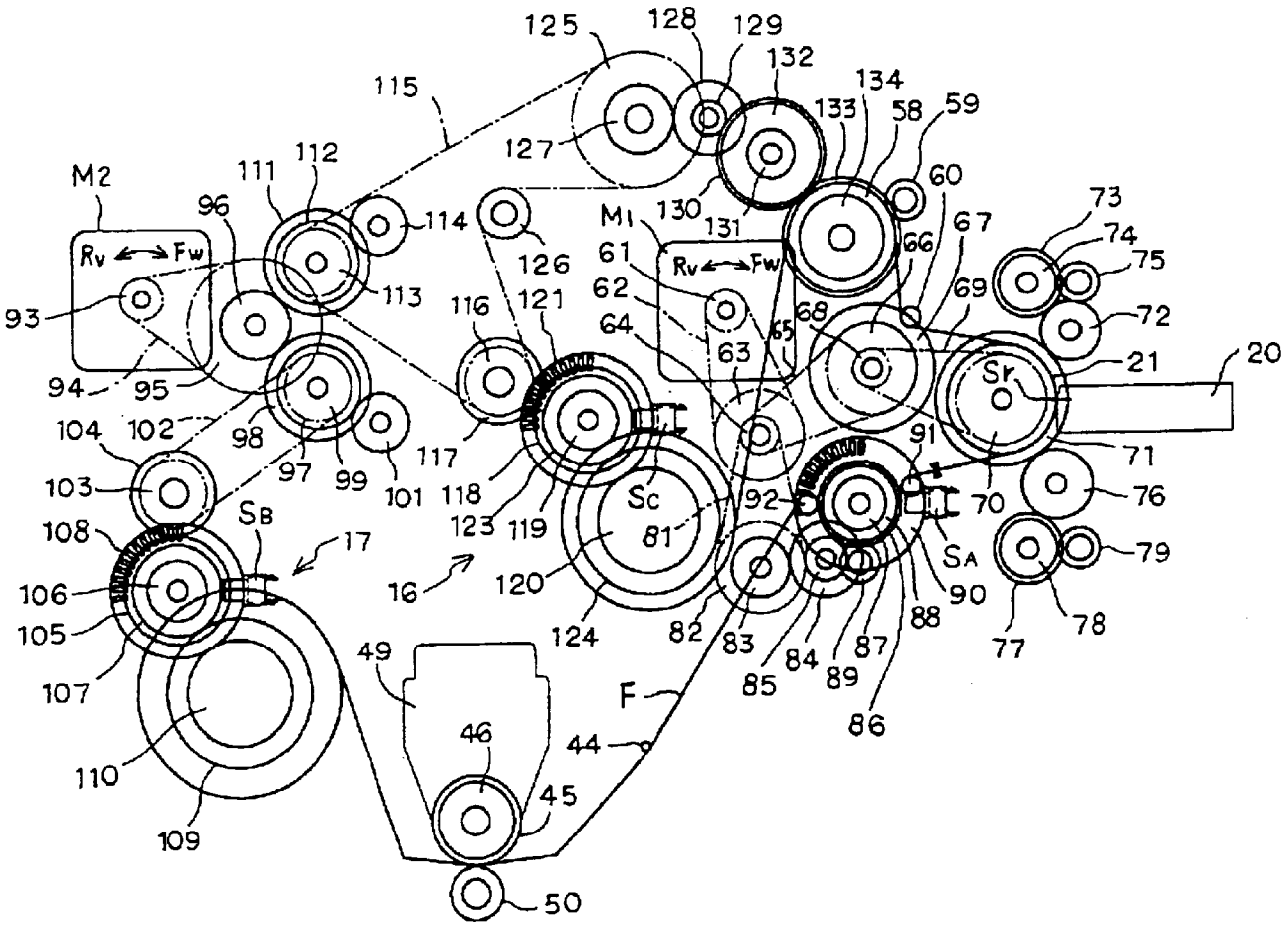
FIG. 3 is a front view showing the card transport mechanism near the intermediate transfer film transport mechanism and image forming portion of the printing apparatus according to an embodiment.

As can be seen in FIG. 3, within the region of the frame 2, the first card transport path P1 and the second card transport path P2 shown in FIG. 1, the drive mechanisms that get their driving force from the reversible pulse motor M1 and the reversible pulse motor M2 are arranged. The timing pulley 61 (hereinafter called the pulley) is mated to the motor shaft on the pulse motor M1 and an endless timing belt 62 (hereinafter called the belt) is trained between the pulley 61 and the pulley 63. To the pulley 63 shaft is mated the pulley 64 having a diameter smaller than the pulley 63.

To the pulley 64, the belt 65 is trained therebetween with the pulley 66. To the pulley 66 shaft is mated the solenoid clutch 67 as a drive interlock switching means. The solenoid clutch 67 interlocks the rotational drive force of the pulley 66 to the pulley 68 which is mated to the solenoid clutch 67 when transporting the card C in a direct transfer, when directly transferring to the card C by the thermal head unit 20 and when forming an image on the intermediate transfer film F using the thermal head unit 20. The pulley 70 is mated to the same shaft as platen roller 21. The belt 69 is trained between the pulley 68 and the pulley 70. Additionally, to the platen roller 21 shaft is mated the gear 71 having a diameter greater than the platen roller 21. To the gear 71 are meshed the gears 72 and 76. The gear 72 meshes with the gear 73 that comprises on the same shaft the capstan roller 74 that presses against the pinch roller 75 and the gear 76 meshes with the gear 77 comprising on the same shaft the capstan roller 78 that presses against pinch roller 79.

Also, another belt, the belt 81, is trained to the pulley 64, transmitting rotational drive force to the pulley 82. To the pulley 82 shaft is mated the gear 83 that meshes with the gear 84. To the gear 84 shaft, the gear 85 having a diameter smaller than the gear 84, is mated. The gear 85 and the gear 86 are meshed. The torque limiter 87 is mated to the shaft of the gear 86, and rotational drive force is transmitted to the back-tension roller 88 via the torque limiter 87. The pinch roller 89 is pressed against the back-tension roller 88. To the same shaft as the back-tension roller 88 is mated the clock plate 90. While the intermediate transfer film F is being fed forward or in reverse, the back-tension roller 88 rotates in synchronization with the intermediate transfer film F. Near the clock plate 90 is arranged the unitized transmissive sensor SA that detects the amount of rotation of the clock plate 90 to control the amount of transport (the amount fed and the amount returned) of the intermediate transfer film F.

To the motor shaft of the pulse motor M2 is mounted the pulley 93. The belt 94 is trained between the pulley 93 and the pulley 95. The gear 96 is mounted to the pulley 95 shaft.

The drive from the gear 96 is transmitted in the counterclockwise direction and the gear 96 meshes with the one-way gear 97 mated to the shaft that is free (freely rotates) in the clockwise direction. To the shaft on the one-way gear 97, the gear 98 and pulley 99 are mounted. The gear 98 meshes with the one-way gear 101 that is free in the clockwise direction and locked in the counterclockwise direction. To the pulley 99, the belt 102 is trained therebetween with the pulley 103. To the pulley 103 shaft, the gear 104 is mounted and meshes with the gear 105. To the gear 105 shaft is mounted the torque limiter 106 which transmits rotational drive force to the gear 107. To the same shaft as the gear 107 is mounted the clock plate 108. The gear 107 meshes with the gear 109 that is mounted to the take-up spool shaft 110 which takes up the intermediate transfer film F. Near the clock plate 108 is disposed the unitized transmissive sensor SB that detects the amount of rotation of the take-up spool shaft 110, via the rotation of the clock plate 108. That detects any breakage in the intermediate transfer film F by detecting the rotation of the take-up spool shaft 110.

The gear 96 meshes with the one-way gear 111, which is mounted on the side opposite to the one-way gear 97. The one-way gear 111 is mounted to a shaft that is free in the counterclockwise direction and transmits drive from the gear 96 in the clockwise direction. To the shaft on the one-way gear 111, the gear 112 and pulley 113 are mounted. The gear 112 meshes in the clockwise direction with the one-way gear 114 that is free in the counterclockwise direction and locked in the clockwise direction. The belt 115 is between the pulley 113, the pulley 116 and the pulley 125. Note, to maintain a constant tension on the belt 115, the tension roller 126 is arranged between the pulley 116 and the pulley 125 which are linked by the belt 115. To the pulley 116 shaft, the gear 117 is mounted and meshes with the gear 118. To the gear 118 shaft is mounted the torque limiter 119 that transmits rotational drive force to the gear 123. To the shaft of the gear 123 is mounted the clock plate 121. The gear 123 meshes with the gear 124 that is mounted to the supply spool shaft 120 to supply the intermediate transfer film F. Near the clock plate 121 is arranged the unitized transmissive sensor SC that detects the rotation of the supply spool shaft 120, via the rotation of the clock plate 121, and that detects any breakage in the intermediate transfer film F by detecting the rotation of the supply spool shaft 120. Note that the intermediate transfer film supply portion 16 is mounted to the supply spool shaft 120, and that the intermediate transfer film take-up portion 17 is mounted to the take-up spool shaft 110.

The drive from the pulley 113 is transmitted to the pulley 125, via the belt 115. To the pulley 125 shaft, the gear 127 is mounted. The gear 127 meshes with the gear 128. Still further, drive is transmitted to the gear 130 via the gear 129 which is disposed on the same shaft as the gear 128. To the pulley 130 shaft is mounted a solenoid clutch 131. The solenoid clutch 131 interlocks the rotational drive force of the gear 130 to the gear 131 via the gear 132 that is mounted to the shaft of the solenoid clutch 131 only when rewinding (Rv) the intermediate transfer film F. To the gear 133 shaft is mounted the torque limiter 134. The rotational drive force is transmitted via the torque limiter 134 to the transport roller 58 that transports the intermediate transfer film F. Note that the speed that the supply spool shaft 120, the platen roller 21 and the transport roller 58 transport the intermediate transfer film F when the solenoid clutch 131 drive is engaged is set so that the speed of the supply spool shaft 120 is higher than the transport roller 58 which is higher than the platen roller 21. Torque control is set so that the platen roller 21 is greater than the transport roller 58 which is greater than the supply spool shaft 120.

The feeding (Fw) and rewinding (Rv) of the intermediate transfer film F is primarily achieved by switching the direction of rotation of the pulse motor M2. When forming images on the intermediate transfer film F while the intermediate transfer film F is being rewound (Rv), the supply spool shaft 20, the platen roller 21 and the back-tension roller 88 are set so that they have the following relationship for the transport speed of the intermediate transfer film F: The supply spool shaft 20 is faster than the platen roller 21 which is faster than the back-tension roller 88. For that reason, when feeding the intermediate transfer film F with the thermal head unit 20 separated, the drive is interrupted by the solenoid clutch 67 to prevent slackening of the intermediate transfer film F.

As can be seen in FIG. 1, formed on the line extended in the direction of arrow L on the second card transport path P2 in the frame 2 is the discharge outlet 27 that discharges the cards C that have been finished printing, to outside of the frame 2. Below the discharge outlet 27, removably mounted from the frame 2 is the stacker 13 that stacks the cards C. Note that the unitized transmissive sensor S7 is arranged between the cleaner 4 and the transfer portion 5, the unitized transmissive sensor S8 is arranged on the capstan roller 78 side near the turning portion 5, the unitized transmissive sensor S9 is arranged between the capstan roller 78 and the thermal head unit 20, the unitized transmissive sensor S10 is arranged on the side of the paired horizontal transport rollers 11 near the paired transport rollers 48, the unitized transmissive sensor S11 is arranged on the paired discharge rollers 142 side near the drive-less paired rollers that are arranged between the paired capstan rollers 141 and the paired discharge rollers 142, and the unitized transmissive sensor S12 is arranged between the horizontal transport portion 12 and discharge outlet 27, and the unitized transmissive sensor S13 is arranged near the turning portion 5 on the paired horizontal transport rollers side. These detect the leading edge or the trailing edge of the card C is transported along the first card transport path P1 or the second card transport path P2. Note that in the following description, other than the direction of the arrows U and D for the card, as a reference for the direction of transport for the card C, the leading edge of the card in the direction of its transport means the leading edge and its trailing edge in the direction of its transport means its trailing edge.

Furthermore, as shown in FIG. 1, in the frame 2, the printing apparatus 1 comprises the power supply unit 18 that converts commercial alternating current power into drive/operable direct current power for each mechanism and control unit. It also comprises the control unit 19 which controls all operations of the printing apparatus 1, and a touch panel 8 on the upper portion of the frame 2 that displays the status of the printing apparatus 1 according to the information received from the control unit 19, and that allows an operator to manually input instructions to the control unit 19.

Figure 5:
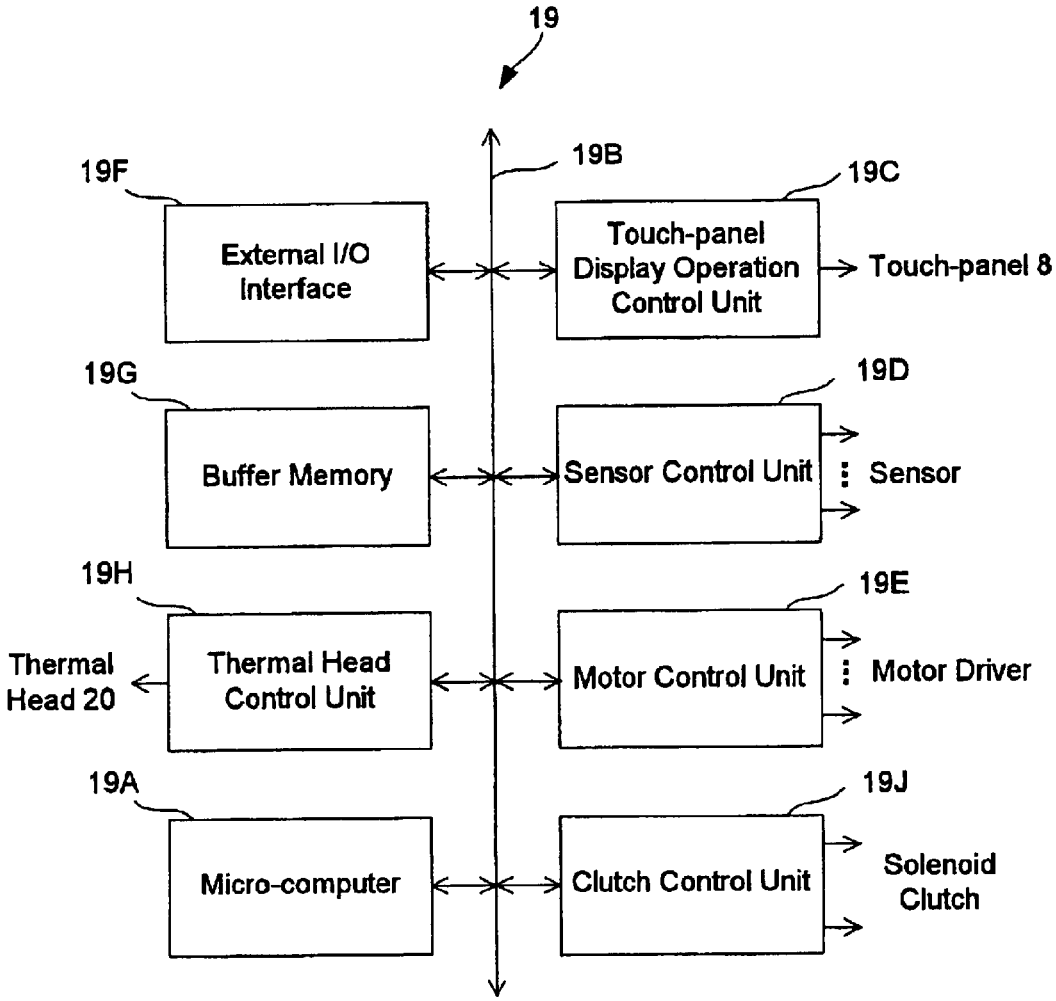
FIG. 5 is a block diagram of the general configuration of the printing apparatus control unit according to an embodiment.

As shown in FIG. 5, the control unit 19 comprises the micro-computer 19A that controls the printing apparatus 1. The micro-computer 19A comprises a CPU that operates with a fast clock speed as the central processing unit, a ROM that stores with control operations for the printing apparatus 1 and an internal bus that connects the RAM and these that act as the working areas on the CPU.

The external bus 19B is connected to the micro-computer 19A. Connected to the external bus 19B are the touch-panel display operation control unit 19C that controls the display and operating instructions of the touch panel 8, the sensor control unit 19D that controls the signals from each sensor, the motor control unit 19E that controls the motor driver for outputting the drive pulses to each motor, the external I/O interface 19F that communicates with a host device such a PC and the printing apparatus, the buffer memory 19G that temporarily stores the image data to be printed on the card C, the thermal head control unit 19H that controls the thermal energy of the thermal head 20 and the clutch control unit 19J that outputs control signals to turn the solenoid clutch on and off. The touch-panel display operation control unit 19C, the sensor control unit 19D, the thermal head control unit 19H and the clutch control unit 19J are each connected to the touch panel 8, the sensors including Sa to Sc and S1 to S13, the drivers that drive the pulse motor drivers of M1 to M4, the thermal head 20 and the solenoid clutches 67 and 131.

The following shall describe the operations of the printing apparatus 1 in this printing apparatus 1 of the present embodiment, focusing on the CPU of the micro-computer 19A in the control unit 19, in reference to the flow charts. Note that the RAM converts the image information received from the external device, like a PC, from the external I/O unit 19F, via the memory buffer 19G into positive or mirrored image data and then stores that data.

When the power is turned on to the printing apparatus 1, the CPU displays an initial screen on the touch-panel 8, via the touch-panel display and operations control unit 19C. At this time, the touch-panel 8 (or the external computer monitor) displays a mode setting button for setting an indirect transfer mode as the first mode, or the direct transfer mode as the second mode, a clear button for clearing the mode set by the mode setting button, a start button for starting printing with the mode set on the printing apparatus 1, and the number of cards that are in standby or ready for printing on the printing apparatus 1, and the number printed and that the image forming routine for forming (printing) an image on the card C can be executed.

Figure 6:
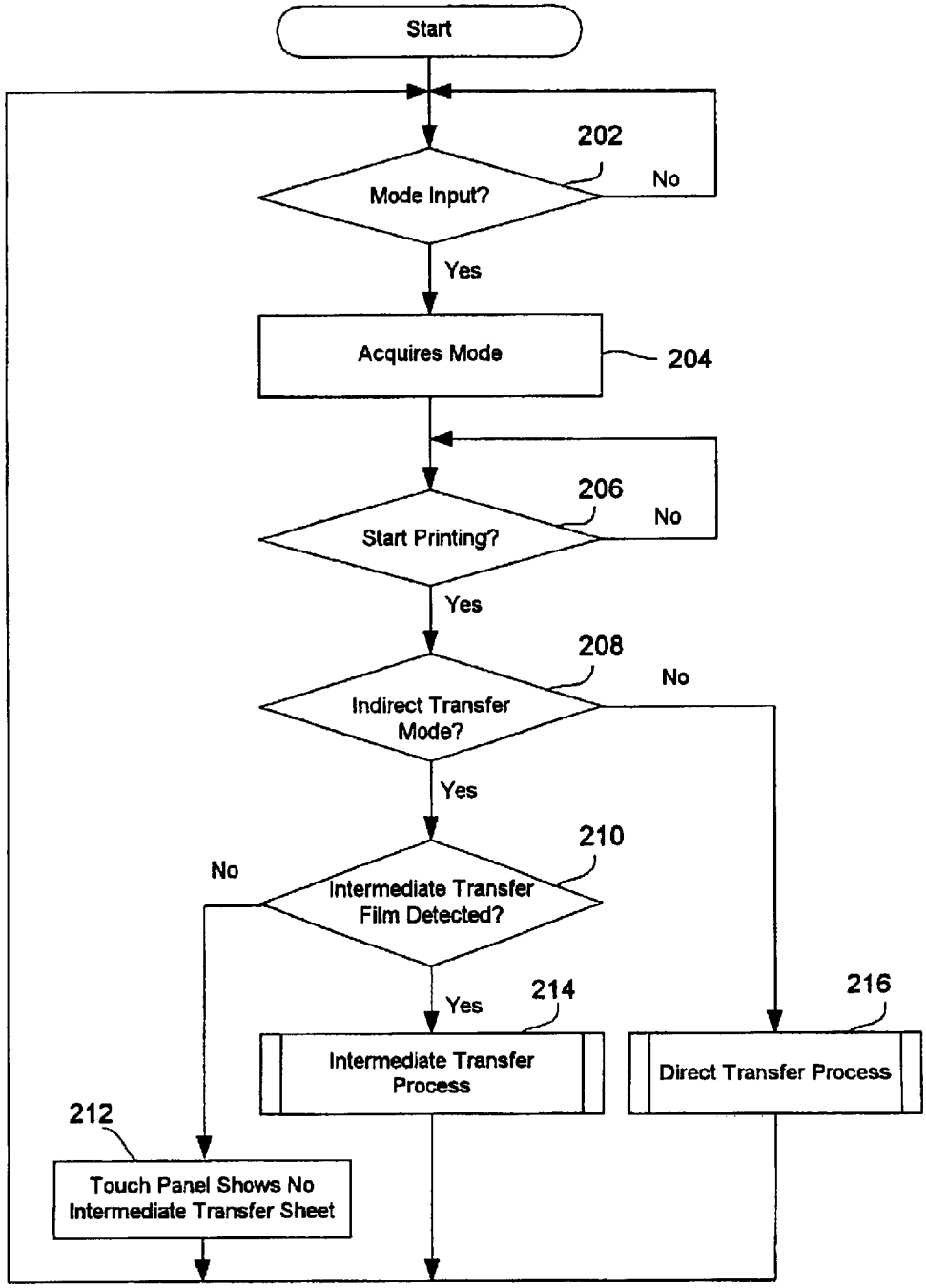
FIG. 6 is an image forming routine flowchart executed by the printing apparatus control unit CPU according to an embodiment.

As shown in FIG. 6, in the image forming routine, first at step 202, the system idles until a mode is input for either the indirect transfer mode or the direct transfer mode from the touch-panel 8 (or external PC). When the mode is input, at the next step 204, the input intermediate transfer mode or direct transfer mode default values are stored (acquired) in RAM. At the next step 206, the system idles until the start of printing is specified from the touch-panel 8 (or the external PC). When printing is started, the system determines at step 208, whether the transfer mode stored in RAM is the intermediate transfer mode. If the judgment at step 208 is affirmative, at the next step of 210, the system determines whether the light receiving sensor S6 has detected the existence of the intermediate transfer film F. If negative, images cannot be formed using the indirect transfer method, so the touch-panel 8 displays that there is no intermediate transfer film F (or notifies that there is no intermediate transfer film F on the PC). This ends the image forming routine and returns to step 202. When affirmative, at step 214, the system executes the indirect transfer processing sub-routine to form images (the second printing process) on the card C using the indirect transfer method.

Figure 7:
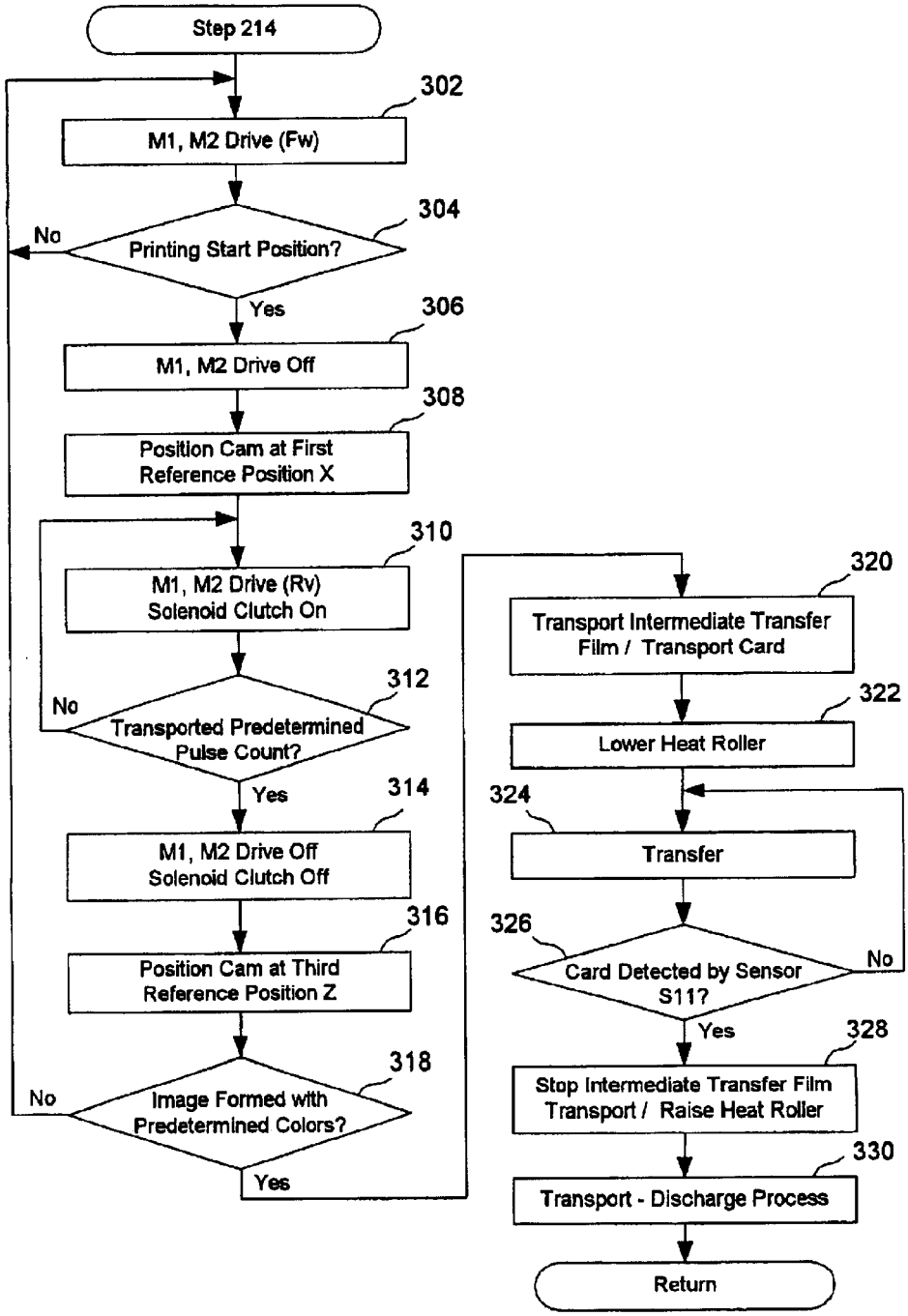
FIG. 7 is a flowchart of a subroutine of the indirect transfer process showing the details of step 214 of the image forming routine.

As shown in FIG. 7, at step 302 in the indirect transfer process sub-routine, the pulse motors M1 and M2 rotate in the feed direction (Fw). At step 304, the mark for positioning formed on the intermediate transfer film F is recognized by monitoring the light reception sensor S2. It is determined whether the intermediate transfer film F has been transported to the printing starting position by detecting the amount of rotation of the clock plate 90 which is connected to the back-tension roller 88 that constantly reversibly rotates as a single unit with the feeding and returning of the intermediate transfer film F. If negative, the system returns to step 302 and continues transporting the intermediate transfer film F. If affirmative, the drive of the pulse motors M1 and M2 are turned off at the next step 306. During that time, the thermal head 20*a* is positioned away from the platen roller 21 (the eccentric cam 23 is positioned at the third reference position Z) and the starting edge of for example Y (yellow) on the thermal transfer film R is fed a predetermined distance to the printing position Sr. Such control is executed by detecting the trailing edge of the Bk (black) portion on the thermal transfer film R using the light emitting sensor S4, and by detecting the rotation of the clock plate, not shown in the drawings, established near the paired take-up rollers 57 using the unitized transmissive sensor, not shown in the drawings, that detects the distance from the trailing edge of the Bk (black) portion having a predetermined width on the thermal transfer sheet R, to the Y (yellow) portion on the thermal transfer sheet R.

Next, at step 308, the pulse motor M4 drives eccentric cam 23 to touch the thermal head 20*a* against the platen roller 21 interposed therebetween by the thermal transfer film R at the first reference position X. Next, at step 310, while rotating the pulse motor M1 and the pulse motor M2 in the take-up (Rv) direction, the platen roller 21 is rotated in the counterclockwise direction by interlocking the solenoid clutches 67 and 131. This rotates the transport roller 58 in the counterclockwise direction. This starts the forming of the image using the color Y (yellow) on the intermediate transfer film F. In other words, the thermal head 20*a* heats the Y (yellow) ink layer on the thermal transfer film R, thereby starting to form the image on the receptive layer Fe on the intermediate transfer film F. The driving force provided by the pulse motor M1 rotates the platen roller 21 in the counterclockwise direction and the driving force of the pulse motor M2 takes up the intermediate transfer film F using the intermediate transfer film supply portion 16. In synchronization to that, the thermal transfer film R is taken up by the thermal transfer film take-up portion 15.

By determining whether the pulse motor M1 has rotatingly driven the predetermined number of pulses that correspond to the size of the length direction of the image formed on the intermediate transfer film F at step 312, it is determined whether the forming of the image on the intermediate transfer film F has been completed. When it is negative, the system returns to step 310 and continues forming the image on the intermediate transfer film F. If affirmative, along with turning off the drive of both the pulse motor M1 and M2 at the step 314, it releases the interlock of the solenoid clutches 67 and 131 on the platen roller 21 and transport roller 58. Note that the CPU reads out image data and converts each line into thermal energy, and sends to the thermal head unit 20 that positive image data with predetermined coefficients applied thereto according to type of intermediate transfer film F. The printing elements of the thermal head 20 are heated according to this mirrored data.

At step 316, the pulse motor M4 drives the eccentric cam 23 to retract the thermal head 20*a* to a third reference position Z away from the platen roller 21. Then, at step 318, it is determined whether the forming of the image for the prescribed colors (YMC) has been completed. If negative, the system returns to step 302 to form the image overlaying the color already formed on the receptive layer on the intermediate transfer film F for example, Y) with the next color (for example, M). If affirmative, in other words, if it is determined that the forming of the image using the colors YMC has been completed, the system proceeds to step 320. This forms a mirrored image onto the intermediate transfer film F.

At the next step of 320, the pulse motor M2 is driven to transport the intermediate transfer film F to the heat roller 45 position which is separated from the platen roller 50 in advance, according to the amount of rotation of the clock plate mounted onto the back-tension roller 88. When transporting, it possible at this point to reset the amount of transport to improve the transporting accuracy of the intermediate transfer film F by monitoring output from the light receiving sensor S6 arranged between the guide roller 44 and the guide plate 47 in the transfer portion 10 and detecting the mark for positioning the intermediate transfer film F. Also, at step 320, in parallel to transporting the intermediate transfer film F to the transfer portion 10, the card C is feed from the card supply portion 3 along the second card transport path P2 until the leading edge thereof touches the heat roller 45. Specifically, while rotatingly driving the card supply portion 3, the cleaner 4 and the pinch rollers 38 and 39 on the turning portion 5, the pulse motor M3, not shown in the drawings, drives to rotate the paired horizontal transport rollers 11, the paired transport rollers 48 and each of the rollers on the horizontal transport portion 12. This sends one card C from the card supply portion 3 to the second card transport path P2 where both surfaces of the card C are cleaned by the cleaner 4. When the unitized transmissive sensor S7, not shown in the drawings, detects the leading edge of the card C, it stops the rotation of the kick roller 31. Continuing, the card C is transported further in the direction of the arrow L through the turning portion 5 along the second card transport path P2. When the unitized transmissive sensor S10, not shown in the drawings, arranged on the paired horizontal transport rollers 11 side near the transport roller 48 detects the leading edge of the card C, the card is transported further a determined number of pulses in the direction of the arrow L. This transports the card C to a position where the leading edge touches the heat roller 45. Note that the point at which the unitized transmissive sensor S10, not shown in the drawings, detects the leading edge of the card C, the rotational drive of the pinch rollers 38 and 39 is turned off.

Figure 10A:
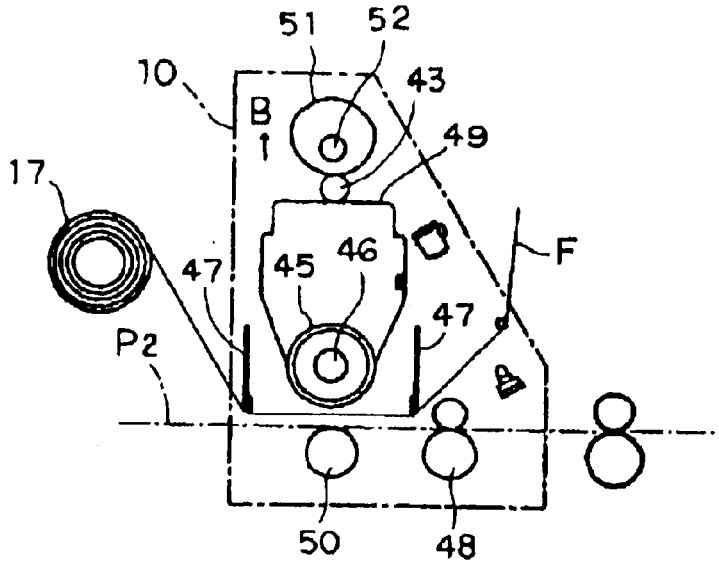
FIG. 10A and FIG. 10B are front views of a transfer portion on the printing apparatus according to an embodiment thereof.
Figure 10B:
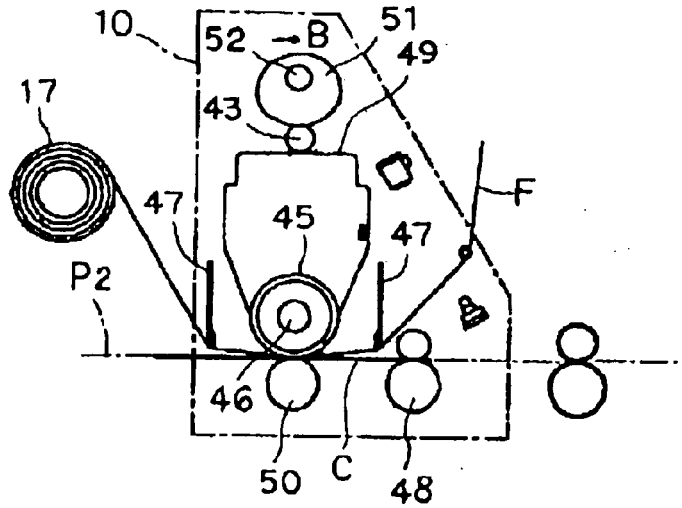

Next, at step 322, the heat roller elevator cam 51 is rotated in the direction of the arrow B in FIG. 10A to shift the heat roller 45 from a separated state from the platen roller 50 to touch the platen roller 50 (see FIG. 10B). Then the rotation of the heat roller elevator cam 51 stops. At this point, the leading edge of the card C touches the heat roller 45, while a side of the card C is supported by the platen roller 50 and the intermediate transfer sheet F is interposed between the other side of the card C and heat roller 45.

Next, at step 324, the system executes an indirect transfer that thermally transfers images formed on the reception layer Fe of the intermediate transfer film F to one side of the card C at the image forming portion 9 using the heat and pressure of the heat roller 45. To describe the operations that occur here at step 324 in more detail, the card C, the other side thereof supported by the platen roller 50 that rotates in the counterclockwise direction, is touched to the heat roller 45 with one surface interposed by the intermediate transfer film F and is transported in the direction of the arrow L. The peeling layer Fc on the intermediate transfer film F is peeled away from the base film Fa by the heat of the heating lamp 46 and through the pressure of the heat roller 45. The layer Fe formed thereupon with images and the overcoat layer are transferred to the other side of the card C as a single body. In synchronization to this transfer, the intermediate transfer film F is taken up by the intermediate transfer film take-up portion 17. During this time, at step 326, by monitoring whether or not the leading edge of the card C is at the unitized transmissive sensor S11 arranged on the paired discharge roller 142 side near the paired rollers that have no drive arranged between the capstan rollers 141 and the paired discharge rollers 142, the system determines whether indirect transfer has been completed. If not completed, it returns to step 324 and continues the indirect transfer. If indirect transfer has been completed, it proceeds to the next step of 328. Images are formed with the positive image over the entire surface of the card C through the transfer that occurs at the transfer portion 10. Note that the transport of the card C and the intermediate transfer film F during indirect transfer are the same speed.

At step 328, by stopping the drive of the pulse motors M2 and M3, the feeding transport of the intermediate transfer film F rewinding to the intermediate transfer film take-up portion 17) and the transport of the card C in the direction of the arrow L are stopped. The heat roller elevator cam 51 is re-rotated to retract the heat roller 45 from the platen roller 50. Then, at step 330, the system executes the transport/discharge process that transports the card C over the second card transport path P2 and discharges it outside of the printing apparatus 1.

In the transport/discharge process that is performed at step 330, the pulse motor M3, not shown in the drawings, drives to transport the card C further in the direction of arrow L along the second card transport path P2. It is determined whether the unitized transmissive sensor S12, not shown in the drawings, arranged between the horizontal transport portion 12 and the discharge outlet 27 has detected the leading edge of the card C. If negative, the card is transported further. If affirmative, transport continues for a predetermined amount of time to completely discharge the card C outside of the frame 2. This discharges the card C to the stacker 13 via the discharge outlet 27. Next, the rotational drive of the pulse motor M3, not shown in the drawings, is stopped and the pulse motors M1 and M2 are driven in reverse. It is determined by the unitized transmissive sensor SA, described above, whether the intermediate transfer film F has been transported the predetermined distance. If negative, the system continues to transport the intermediate transfer film F. If affirmative, the system stops the drives of the pulse motors M1 and M2, completes the indirect transfer sub-routine and returns to step 202.

If the decision is negative (direct transfer mode) at step 208 in FIG. 6, the direct transfer sub-routine for forming images (the first printing process) on the card C using the direct transfer method is executed at step 216.

Figure 8:
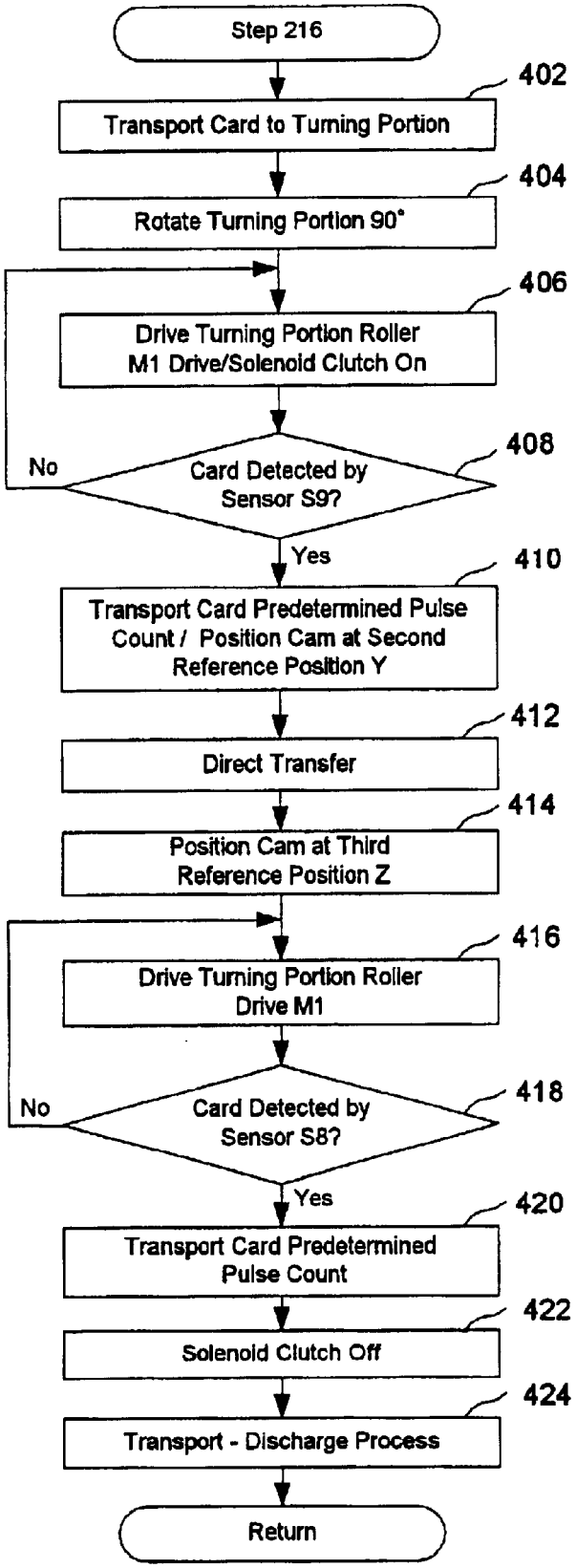
FIG. 8 is a flowchart of a subroutine of the direct transfer process showing the details of step 216 of the image forming routine.

As shown in FIG. 8, with the direct transfer routine at step 402, the card supply portion 3 arranged on the second card transport path P2, the cleaner 4 and each of the rollers on the turning portion 5 operate to transport the card C from the card supply portion 3 in the direction of the arrow L whereat the card C is nipped by the pinch rollers 38 and 39 in the turning portion 5. In other words, by rotating the kick roller 31 on the card supply portion 3, the bottommost card C in the card stacker is fed to the second card transport path P2 whereat both sides of the card C are cleaned by the cleaning roller 34 on the cleaner 4. When the leading edge of the card C has been detected by the unitized transmissive sensor S7, not shown in the drawings, arranged between the cleaner 4 and the transfer portion 5, the rotation of the kick roller 31 on the card supply portion 3 is stopped. The card C is stopped after it is transported a predetermined number of pulses after passing the position where it was detected by the unitized transmissive sensor S7 to the turning portion 7 (the rotational drive of the pinch rollers 38 and 39 is also stopped) and the horizontally positioned turning portion 5 nips both ends of the card C.

Next, at the step 404, the turning portion 5 is rotated 90° to become vertically oriented (see the dotted lines in FIG. 1) to transport the card C in the direction of the arrow U over the first card transport path P1. Next, at step 506, while rotatingly driving the pinch rollers 38 and 39, the rotating drive of the pulse motor M1 starts to the pulse motor M1 motor driver while the solenoid clutch 67 transmits drive force from the pulse motor M1 to the platen roller 21. Through this, the rotational drive of the pinch rollers 38 and 39, the platen roller 21, and the capstan rollers 74 and 78 is started to begin the transport of the card C to the image forming portion 9 along the first card transport path P1. Also, the transport is started for the intermediate transfer film F toward the intermediate transfer film supply portion 16 (to be rewound).

At the next step 408, the system determines if the unitized transmissive sensor S9, not shown in the drawings, which is arranged between the capstan roller 78 and the thermal head unit 20 has detected the leading edge of the card C. If negative, the system returns to step 406 and continues the transport of the card C to the image forming portion 9. If affirmative, at step 410, it transports the card C a predetermined number of pulses in the direction of arrow U until the leading edge of the card C reaches the printing position Sr. The pinch rollers 38 and 39 on the turning portion 5 stop rotating at the point where the unitized transmissive sensor S8, not shown in the drawings, arranged between the turning portion 5 and the image forming portion 9, detects the trailing edge of the card C. During that time, the thermal head 20*a* is positioned away from the platen roller 21 (the eccentric cam 23 is positioned at the third reference position Z) and the starting edge of Bk (black) on the thermal transfer film R is fed a predetermined distance to the printing position Sr. Also, at step 410, after feeding the thermal transfer film R a predetermined distance, the system drives the pulse motor M4 to position the eccentric cam 23 at the second reference position Y This supports the other side of the card C at the platen roller 21 interposed by the intermediate transfer film F. One side touches the thermal head unit 20 interposed by the thermal transfer film R.

Continuing, at step 412, images are formed on one side of the card C using the direct transfer method. The CPU converts each line (or a plurality of lines) of the image data into thermal energy, adding predetermined coefficients to that thermal energy according to the type of card C, and sends that to the thermal head unit 20, via the image forming control unit 19C. The printing elements of the thermal head 20*a* are heated according to this positive data. The pulse motor M1 drive rotates the platen roller 21 in the counter-clockwise direction. In synchronization to that, the thermal transfer film R is taken-up by the thermal transfer film take-up portion 15 and images, such as cautions for use, are formed (printed) to one side of the card C in Bk (black) using the direct transfer method. This forms positive images over the entire surface (all areas) of the card C. Note that the intermediate transfer film F is transported at the same speed as the thermal transfer film R and the card C.

At the next step 414, the pulse motor M4 drives the eccentric cam 23 to the third reference position Z thereby retracting the thermal head 20*a* from the card C. At step 416, after reversingly driving the pinch rollers 38 and 39, the reverse drive of the pulse motor M1 starts to reversingly rotate the platen roller 21 and the capstan rollers 74 and 78, thereby transporting the card C in the direction of the arrow D.

At step 418, the system determines whether the trailing edge of the card C has been transported to the position of the unitized transmissive sensor S8, which is not shown in the drawings. If it is determined to be negative, the system returns to step 416 and continues to transport the card C in the direction of the arrow D (see FIG. 1). If affirmative, at the next step 420, it transports the card C a predetermined number of pulses further in the direction of the arrow D (see FIG. 1). Next, at step 422, when the drive of the pulse motor M1 is stopped, the system the interlock to the platen roller using the solenoid clutch 67. The reverse rotation of the pinch rollers 38 and 39 in the vertically oriented turning portion 5 is stopped to nip both edges of the card C therein. At step 424, the system executes the transport/discharge process to transport the card C over the second card transport path to outside of the printing apparatus 1.

In the transport/discharge process at step 424, the vertically oriented turning portion 5 is rotated 90° to allow the card C positioned on the first card transport path P1 to be transported in the direction of the arrow L in FIG. 1, on the second card transport path P2. This positions the card C with the other side facing upward, on the second card transport path P2. Next, the pulse motor M3, which is not shown in the drawings, drives to transport the card C further in the direction of arrow L along the second card transport path P2. The system determines whether the unitized transmissive sensor S12, which is not shown in the drawings, arranged between the horizontal transport portion 12 and the discharge outlet 27 has detected the leading edge of the card C. If negative, the card is transported further. If affirmative, transport continues for a predetermined amount of time to completely discharge the card C outside of the frame 2. The rotating drive of the pulse motor M3 is turned off, the direct transfer sub-routine is completed and the system returns to step 202. This discharges the card C to the stacker 13 via the discharge outlet 27. Note that the point at which the unitized transmissive sensor S10, not shown in the drawings, detects the leading edge of the card C, the rotational drive of the pinch rollers 38 and 39 is turned off. Also, in direct transfer, as shown in FIG. 10A, the heat roller 45 on the transfer portion 10 remains separated from the platen roller 50.

The following provides a description of the actions on the printing apparatus 1 according to the present embodiment.

Note that according to the present embodiment of the invention, the printing apparatus 1 comprises an image forming portion 9 that forms images on a card C or onto the intermediate transfer film F, and a transfer portion 10 that transfers images formed on the intermediate transfer film F to the card C, so as illustrated with the image forming routine, it is possible to print using both of the direct transfer method and indirect transfer method. Furthermore, because it is possible to freely form images to the card C and to the intermediate transfer film F with a single print head unit 20, a more compact and lower costing printing apparatus 1 is possible.

Also, with the printing apparatus 1 of the present embodiment, when forming an image onto the intermediate transfer film F in the indirect transfer mode (the first mode), using the indirect transfer process sub-routine (the second printing process), the system drives the pulse motor M4, not shown in the drawings, to position the eccentric cam 23 at the first reference position X. This applies the thermal head 20*a* with the pressure of approximately 78 N to the intermediate transfer film F which has substantially no hardness (it is a soft material) because it is a film-shape. Also, because the intermediate transfer film F is directly supported by the platen roller 21 which has a degree of hardness of approximately 60 degrees Hs, the thermal head 20*a* presses against the intermediate transfer film F for having a degree of hardness of approximately 60 degrees, with approximately 78N. Also, when forming an image onto the card C in the direct transfer mode (the second mode), using the direct transfer process sub-routine (the first printing process), the system drives the pulse motor M4 to position the eccentric cam 23 at the second reference position Y This applies (at step 410) the thermal head 20*a* with the pressure of approximately 98 N (approximately 39 N) to the card C (it is a hard material). Therefore, when forming an image, a pressure is applied to the softer material of the intermediate transfer film F which is larger than the pressure applied to the harder material of the card C, by the thermal head 20*a*. Also, the intermediate transfer film F is supported by the platen roller, so its degree of hardness is higher. For that reason, even if forming an image onto an intermediate transfer film F and card C that comprise extremely different degrees of hardness, using either the indirect transfer method or the direct transfer method with a single thermal head 20*a*, the appropriate pressure per unit of surface area can be applied by the thermal head 20*a* onto the intermediate transfer film F and the card C. Therefore, high quality images can be formed on the intermediate transfer film F and the card C without missing transfers.

Still further, on the printing apparatus 1 of the present embodiment, when idling, no pressure is applied to the intermediate transfer film F and the card C (it does not touch the thermal transfer film R, the intermediate transfer film F and the card C) by the eccentric cam 23, because it is positioned at the third reference position Z (step 316 and 414). Therefore, there is no hindrance in the transporting of the thermal transfer film R, the intermediate transfer film F and the card C or mis-operations.

On the printing apparatus 1 according to the present embodiment, the thermal head drive mechanism is configured to comprise a spring 41*b* to absorb resistance generated in the direction opposite to the pressing direction on the intermediate transfer film F and the card C, so it is possible to absorb the resistance from the intermediate transfer film F and the card C with regard to the pressing force by the eccentric cam 23 and maintain each of the pressing forces at a constant. Also, because the eccentric cam 23, the spring 24, the follower rollers 22 and the spring 41*b* are paired together and arranged in the same direction along the length direction of the thermal head unit 20, it is possible to touch the entire surface of the thermal head 20*a* onto the intermediate transfer film F and card C substantially uniformly to ensure precise printing (image forming) and attain an image that has a stable image quality.

Still further, with the printing apparatus 1 according to the present embodiment, because indirect transfer is performed after a light reception sensor S6 detects the existence of the intermediate transfer film F it is possible to set the pressing force to amount appropriate to press the intermediate transfer film F from the thermal head drive mechanism 42, and to prevent mis-operations between the intermediate transfer film F and the card C.

Note that according to this embodiment, the system waits at step 202 until there is an input of the mode. When the mode is input, at step 204, the input mode default values are stored in RAM and the system determines at step 208 whether the mode is for the intermediate transfer mode. Omitting steps 202, 204 and 208, when the start button is pressed at step 206, the system determines whether the light reception sensor S6 has detected the existence of the intermediate transfer film F at step 210, and executes the indirect transfer process sub-routine at step 214. In this way, by detecting the existence of the intermediate transfer film F, the system drives the pulse motor M4, not shown in the drawings, to position the eccentric cam 23 at the first reference position X and to apply a pressing force of the thermal head 20*a* that is large (larger than when applied to the card C), to eliminate operating mistakes.

Also, according to this embodiment, the rotation of the eccentric cam 23 on the thermal drive mechanism 42 is controlled for the series of operational states of the thermal head unit 20 to be at a printing state and a printing idle state, but it is also perfectly acceptable to configure this to be rotatable in both the forward and reverse directions, even if the eccentric cam 23 rotating direction is unidirectional. If configured to be rotatable in both the forward and in the reverse directions, high speed processing of the thermal head 20*a* to allow it to quickly correspond to either position (or state), and if configured to rotate only in one of either of those directions, it is possible to reduce the cost of the pulse motor M4 and pulse motor driver.

Still further, although this embodiment provides an example of forming images to one side of the card C using the direct transfer method or the indirect transfer method, it is also perfectly acceptable to form images on one side of the card C using the direct transfer method and to form images on the other side of the card C using the indirect transfer method. To perform this type of duplex printing, we shall focus on the function of the turning portion 5. Excluding step 330 in FIG. 7, after executing the indirect transfer sub-routine, the card C can be transported to turning portion 5, rotated 90° and then, in order to form images using direct transfer onto the surface opposite to that which images were formed using the indirect transfer, the following is possible. Even if executing the direct transfer process sub-routine after step 406 in FIG. 8, after the indirect transfer sub-routine, excluding step 424, shown in FIG. 8 is executed, the indirect transfer sub-routine is executed while the card C is nipped in the turning portion 5. Then, the card C, still nipped in the turning portion 5 at step 320 in the indirect transfer sub-routine, is rotated 90° so that it can then be transported to the transfer portion 10. Note that, in this case, after the unitized transmissive sensor S11, which is arranged near the turning portion 5 on the paired horizontal transport rollers 11 side, detects the leading edge of the card C being transported in the direction of the arrow R in FIG. 1, the CPU transports the card C a predetermined number of steps in the direction of the arrow R to nip the card in the turning portion 5.

Also, this embodiment describes the intermediate transfer film with the intermediate transfer film supply portion 16 mounted onto the supply spool shaft 120 and the intermediate transfer film take-up portion 17 mounted on the take-up spool shaft 110, but it is also perfectly acceptable to mount a hologram film supply portion onto the supply spool shaft 120, mount the hologram film take-up portion 17 onto the take-up spool shaft 110 to transfer to the card C hologram film printed continuously thereupon for security with predetermined patterns. In this case, it is also possible to share the take-up spool shaft 110, but establish a supply spool shaft for the hologram film which is separate from the supply spool shaft 120.

Also, this embodiment describes one example of the image forming portion 9 but this invention is not limited to one and can also comprise a plurality of image forming portions 9 (for example two). In this way, at one image forming portion, images can be formed on the card C, and images can be formed on the intermediate transfer film F at the other image forming portion. This further enhances printing speed while reducing errors such as entangling of the intermediate transfer sheet. In this aspect of the invention, the thermal head on the image forming portion is pressed by the thermal head drive mechanism toward the intermediate transfer film F when positioned at the image forming position. It can also be configured to increase the pressing against the card C when the thermal head on another image forming portion is positioned at the image forming position.

Also, according to this embodiment, we focused on an example to start printing or to input a mode using the touch-panel 8, but it is without argument that it is also perfectly acceptable to perform the same operations from an external PC. In addition, the above embodiment describes an example where image data is received from the PC. However, it is also perfectly acceptable to store image data in the control unit 19 microcomputer 19A RAM, VRAM or SDRAM via information recording media such as an FD, MO or ZIP disk. Also, the above invention is not limited to the hardness of the platen roller 21, the intermediate transfer film F and the card C, and can change within the scope of the appended claims.

As described above, the pressure application means in this invention applies a pressure to a soft first transfer medium that is higher than that applied to a hard second transfer medium in the printing means, so the appropriate amount of pressure is applied to the transfer medium regardless of any differences in degrees of hardness. This has the effect of ensuring high quality printed images without missing transfers.

Note that the invention described herein claims priority rights from Japanese patent application No. 2002-102741 filed before the Japanese patent office.

What we claim is:

1. A printing apparatus having at least one printing means for forming images on a plurality of transfer media of differing degrees of hardness, that forms images onto a transfer medium with said printing means pressed against said transfer medium, comprising pressing application means for applying a pressure to said printing means so the pressure applied to a soft first transfer medium is higher than the pressure applied to a hard second transfer medium when forming images to said transfer medium.

2. The printing apparatus according to claim 1, further comprising mode setting means for setting a first mode for forming an image on said first transfer medium, or a second mode for forming an image on said second transfer medium; and pressure control means for controlling to vary the pressure applied by said pressure application means to said printing means according to said first mode or said second mode set by said mode setting means.

3. The printing apparatus according to claim 2, wherein said pressure application means comprises advancing and retreating regulating member for advancing and retreating said printing means between an image forming position and a retreated position separated from said image forming position; and a resilient member for absorbing resistance generated in a direction opposite to the pressing direction on said first transfer medium or said second transfer medium of said printing means the position thereof regulated by said advancing and retreating regulating means.

4. The printing apparatus according to claim 3, wherein said advancing and retreating regulating member comprises a first reference position to apply a high pressure on said first transfer medium, a second reference position to apply a low pressure on said second transfer medium, and a third reference position that does not apply pressure to either said first or said second transfer medium, on an eccentric cam that has an outer surface.

5. The printing apparatus according to claim 1, further comprising detection means for detecting the existence of said first transfer medium; and pressure control means for controlling so that the pressure applied by said pressure application means on said printing means is high, based on a detection signal from said detection means.

6. The printing apparatus according to claim 5, wherein said pressure application means comprises advancing and retreating regulating member for advancing and retreating said printing means between an image forming position and a retreated position separated from said image forming position; and a resilient member for absorbing resistance generated in a direction opposite to the pressing direction on said first transfer medium or said second transfer medium of said printing means the position thereof regulated by said advancing and retreating regulating means.

7. The printing apparatus according to claim 6, wherein said advancing and retreating regulating member comprises a first reference position to apply a high pressure on said first transfer medium, a second reference position to apply a low pressure on said second transfer medium, and a third reference position that does not apply pressure to either said first or said second transfer medium, on an eccentric cam that has an outer surface.

8. The printing apparatus according to claim 1, wherein said first transfer medium is composed of a film-shaped transfer medium; and said second transfer medium is composed of a card-shaped transfer medium having a predetermined degree of hardness.

9. A printing apparatus comprising:

first printing means for forming an image on a recording medium;

second printing means for forming an image on an intermediate transfer medium that temporarily holds said image;

transfer means for transferring images formed on said intermediate transfer medium to said same recording medium or a different recording medium; and advancing and retreating means for advancing and retreating said first printing means and said second printing means between an image forming position and a retreated position separated from said image forming position;

wherein said printing apparatus is configured so that the pressure applied to said intermediate transfer medium of said second printing means when said second printing means is positioned at said image forming position by said advancing and retreating means is higher than the pressure applied to said recording medium of said first printing means when said first printing means is positioned at said image forming position by said advancing and retreating means.

10. The printing apparatus according to claim 9, further comprising mode setting means for setting a first mode for transferring an image on said transfer medium to said same recording medium or a different recording medium by said transfer means, after forming an image on said intermediate transfer medium by said second printing means, or a second mode for forming an image on said recording medium by said first printing means; and pressure control means for controlling to vary the pressure applied to said first printing means or said second printing means positioned at said image forming position by said advancing and retreating means, according to a first or a second mode set by said mode setting means.

11. The printing apparatus according to claim 10, wherein said advancing and retreating means comprises an eccentric cam that regulates the amount of movement in the advancing or retracting movement of said first printing means and said second printing means, the rotation of said eccentric cam is structured to position said first printing means or said second printing means at said image forming position.

12. The printing apparatus according to claim 11, wherein said advancing and retreating means further comprises a resilient member to absorb resistance in the pressure generated by said first printing means and said second printing means.

13. The printing apparatus according to claim 12, wherein said first printing means and said second printing means further comprise a thermal head to perform thermal transfers, said eccentric cam and said resilient member are arranged in pairs in the same direction as the length direction of said thermal head.

14. The printing apparatus according to claim 9, further comprising detection means for detecting the existence of said intermediate transfer medium; and pressure control means for controlling so that the pressure applied to said second printing means positioned at said image forming position by said advancing and retreating means is higher than the pressure applied to said first printing means positioned at said image forming position by said advancing and retreating means, based on a detection signal from said detection means.

15. The printing apparatus according to claim 14, wherein said advancing and retreating movement means comprises an eccentric cam that regulates the amount of movement in the advancing or retracting movement of said first printing means and said second printing means, the rotation of said eccentric cam is structured to position said first printing means or said second printing means at said image forming position.

16. The printing apparatus according to claim 15, wherein said advancing and retreating means further comprises a resilient member to absorb resistance in the pressure generated by said first printing means and said second printing means.

17. The printing apparatus according to claim 16, wherein said first printing means and said second printing means further comprise a thermal head to perform thermal transfers, said eccentric cam and said resilient member are arranged in pairs in the same direction as the length direction of said thermal head.

18. The printing apparatus according to claim 9, wherein the printing elements of said first printing means and said second printing means are composed of the same printing elements.

19. The printing apparatus according to claim 9, wherein said recording medium is composed of card-shaped recording medium having a predetermined degree of hardness; and said intermediate transfer medium is composed of a transfer medium formed of a film-shape.

20. A printing method including:

a first printing method for transporting a card-shaped recording medium having a predetermined degree of hardness to an image forming position and for forming an image on said recording medium at said image forming position; and a second printing method that transports a film-shaped intermediate transfer medium that temporarily holds images to said image forming position and transports said card-shaped recording medium or a different card-shaped recording medium to said image transfer position while transporting said intermediate transfer medium to said image transfer position after forming an image on said intermediate transfer medium at said image forming position and that transfers an image formed on said film-shaped intermediate transfer medium to the said card-shaped recording medium or a different card-shaped recording medium at said image transfer position;

wherein the pressure applied to said film-shaped intermediate transfer medium is higher when forming an image on said film-shaped intermediate transfer medium in said second printing method than the pressure applied to said card-shaped recording medium when forming an image to said card-shaped recording medium in said first printing method, to form an image.

* * * * *